US008925472B2

(12) United States Patent
Sakuma et al.

(10) Patent No.: US 8,925,472 B2
(45) Date of Patent: Jan. 6, 2015

(54) GAS CARRYING THREADING DEVICE OF SEWING MACHINE

(75) Inventors: Kouichi Sakuma, Yamagata (JP); Masato Ishikawa, Yamagata (JP)

(73) Assignee: Suzuki Manufacturing, Ltd., Yamagata (JP)

( * ) Notice: Subject to any disclaimer, the term of this patent is extended or adjusted under 35 U.S.C. 154(b) by 63 days.

(21) Appl. No.: 13/399,071

(22) Filed: Feb. 17, 2012

(65) Prior Publication Data

US 2012/0210922 A1 Aug. 23, 2012

Related U.S. Application Data

(63) Continuation of application No. PCT/JP2010/003177, filed on May 10, 2010.

(30) Foreign Application Priority Data

Aug. 17, 2009 (JP) ..... 2009-188670
Nov. 10, 2009 (JP) ..... 2009-256959

(51) Int. Cl.
*D05B 57/02* (2006.01)
*D05B 87/02* (2006.01)

(52) U.S. Cl.
CPC ..... *D05B 57/02* (2013.01); *D05B 87/02* (2013.01)
USPC ..... 112/302; 112/199

(58) Field of Classification Search
CPC ..... D04B 57/00; D04B 57/02; D04B 57/12; D04B 87/00; D04B 87/02; D04B 87/04
USPC ..... 112/302, 192, 199, 165, 166, 220, 194, 112/197
See application file for complete search history.

(56) References Cited

U.S. PATENT DOCUMENTS

| | | | | |
|---|---|---|---|---|
| 4,198,915 | A * | 4/1980 | Peterson et al. | 112/225 |
| 5,327,841 | A | 7/1994 | Sakuma | |
| 7,523,712 | B2 * | 4/2009 | Sadasue | 112/302 |
| 7,536,964 | B2 * | 5/2009 | Sadasue | 112/302 |
| 2008/0134950 | A1 | 6/2008 | Sadasue | |
| 2008/0257241 | A1 | 10/2008 | Sadasue | |

FOREIGN PATENT DOCUMENTS

| | | |
|---|---|---|
| JP | 3355214 | 10/1994 |
| JP | 4088504 | 4/2004 |

* cited by examiner

*Primary Examiner* — Danny Worrell
(74) *Attorney, Agent, or Firm* — LaRiviere, Grubman PC

(57) ABSTRACT

Pressurized gas for carrying looper thread by gas is generated by gas supply pump operated by changing over a sewing-machine motor, which drives stitch forming device, looper threading is performed through loopers by one-touch operation. Gas carrying threading device of sewing machine, comprising: looper thread introduction mechanism inserts looper thread guided to loopers; hollow looper thread guide extends from looper thread introduction mechanism to looper thread inlets and has looper thread guide outlets; gas supply pump for performing looper threading by carrying looper thread by gas from looper thread introduction area through hollow looper thread guide to looper thread loop-taker point outlets; clutch for transmitting power from sewing machine motor M to drive shaft which drives stitch forming device including loopers at time of stitch formation or to gas supply pump at time of looper threading.

14 Claims, 23 Drawing Sheets

(a)
(b)

GAS CARRYING THREADING DEVICE OF SEWING MACHINE

FIELD OF THE ART

The present invention relates to a gas carrying threading device of sewing machine, particularly relates to the gas carrying threading device of sewing machine such as a serger, a double chain stitch sewing machine, or a interlock stitch sewing machine for performing a threading automatically to a looper by utilizing a pressurized gas.

BACKGROUND OF THE ART

Heretofore, in such as the serger, the double chain stitch sewing machine, or the interlock stitch sewing machine, the gas carrying threading device which is connected by a hollow looper thread guide which leads from a thread introduction portion which inserts the looper thread to a looper thread guide outlet of a loop-taker point of the looper and which feeds a looper thread by utilizing a flow of a pressurized gas which is supplied to the hollow looper thread guide is known. Herewith, a complicated thread guard is unnecessary and a threading that a handleability is easy can be performed. Therefore, there are no mistake of the threading, no protrusion of the thread in mid-process, and no entanglement of the inserted looper thread with other thread, and thereby the threading can be performed at once by the extremely easy operation (Patent document No. 1-No. 3).

PRIOR ART DOCUMENT

Patent Document

[Patent document No. 1] JP-2865470
[Patent document No. 2] JP-3355214
[Patent document No. 3] JP-4088504 (FIG. 15-FIG. 19)

SUMMARY OF THE DEVICE

Problem to be Solved by the Device

In a structure of such the gas carrying threading, a pathway for the threading becomes considerably simple, and an operation of the threading becomes easy, and an entanglement of the thread or an incidence of a thread breakage can be dissolved.

However in the structure of such the gas carrying threading, in the case of threading operation, when inserting the looper thread from the thread introduction portion, it is insufficient to perform certainly the thread introduction of the looper thread for an operator who is not accustomed for the gas carrying threading.

Besides, in the structure of such the gas carrying threading, because a means for generating the pressurized gas for performing the gas carrying of the looper thread is performed manually, a manual work of the threading is troublesome for the operator like a delicate female, and a hardship is forced.

Further, in the structure of such the gas carrying threading, while pressing a stopper (positioning pin) for a stop positioning plate by one hand, a pulley is rotated by hand by the other hand, and thereby a stitch forming device must be locked and concurrently a threading connecting device must be connected. Therefore, it is difficult to understand how to use this threading device for the operator who is not familiar with the sewing machine, and an insertion operation of the thread which is performed by using both hands concurrently is considerably complex, thereby the training of that purpose is necessary.

The present invention was conducted to solve these difficult points. In the insertion operation of the thread, the object of the present invention is to provide the gas carrying threading device of sewing machine which is equipped with a looper thread introduction mechanism which performs the looper thread introduction certainly when inserting the looper thread from an thread introducing part.

Besides, the object of the present invention is to provide the gas carrying threading device of sewing machine that the pressurized gas for the gas carrying of the looper thread is produced by a gas supply pump which is operated by changing over a sewing machine motor which drives a stitch forming device, and that the threading to the looper can be performed by one-touch operation.

Further, the object of the present invention is to provide the gas carrying threading device of sewing machine which can perform a looper threading changeover operation in one hand by a looper threading/stitch forming changeover mechanism.

Means for Solving the Problems

In order to achieve such the object, a gas carrying threading device of sewing machine of the present invention is equipped with at least one looper which has a hollow structure from a looper thread inlet to a looper loop-taker point thread outlet, a looper thread introduction mechanism which inserts a looper thread which is led to the looper, a hollow looper thread guide which extends from the looper thread introduction mechanism to the looper thread inlet and has a looper thread guide outlet, and a gas supply source that a looper threading of the looper thread is performed from the looper thread introduction mechanism to the looper thread guide outlet through the hollow looper thread guide by the gas carrying. The looper thread introduction mechanism has a wide-mouthed looper thread insertion slot which inserts the looper thread, a looper thread inhalation area which leads to the wide-mouthed looper thread insertion slots, a gas buffer area that pressurized gas is supplied from the gas supply source and a looper thread introduction pipe which fits to the looper thread inhalation area at one end and is connected to the hollow looper thread guide at the other end, and the looper thread inhalation area and the looper thread introduction pipe form a ventilation narrow area which leads to the gas buffer area and generates a jet stream in a downstream portion of the looper thread inhalation area.

In the gas carrying threading device of sewing machine of the present invention, a looper thread guide outlet end of the looper thread inhalation area is formed slantingly, and generation of a vortex flow in a downstream side of the ventilation narrow area is prevented.

In the gas carrying threading device of sewing machine of the present invention, A bottleneck portion is formed in the inside of the looper thread introduction pipe which is adjacent to the looper thread inhalation area in the downstream side of the ventilation narrow area, and the gas flow in the ventilation narrow area is promoted by reducing the pressure of the downstream side of the bottleneck portion and the looper thread is inhaled into the looper thread introduction pipe by generating negative pressure in the looper thread introduction area, and the gas carrying is performed to the looper thread loop-taker point outlet of the looper through the hollow looper thread guide.

In the gas carrying threading device of sewing machine of the present invention, the looper thread guide outlet and the looper thread inlet are disposed at the time of the looper threading and at the time of the sewing by the sewing machine respectively so that approach/separation becomes free.

The gas carrying threading device of sewing machine of the present invention is equipped with at least one looper which has a hollow structure from a looper thread inlet to a looper loop-taker point thread outlet, a looper thread introduction mechanism which inserts a looper thread which is led to the looper, a hollow looper thread guide which extends from the looper thread introduction mechanism to the looper thread inlet and has a looper thread guide outlet, a gas supply pump that a looper threading of the looper thread is performed from the looper thread introduction mechanism to the looper thread guide outlet through the hollow looper thread guide by the gas carrying, a clutch for respectively transmitting power from the sewing machine motor to a drive shaft which drives a stitch forming device including the looper at the time of the stitch formation or to the gas supply pump at the time of the looper threading, and a looper threading/stitch forming changeover mechanism for changing over the clutch so that the transmission of the power to the stitch forming device is interrupted and the power is transmitted to the gas supply pump at the time of the looper threading and so that the power is transmitted to the stitch forming device and the transmission of the power to the gas supply pump is interrupted at the time of the stitch formation.

In the gas carrying threading device of sewing machine of the present invention, the clutch comprises a pin clutch which has a clutch slider which is moved to one of a pump drive member which transmits the power to the gas supply pump and a stitch forming drive member which is fixed to one end of the drive shaft and that the power is transmitted to the stitch forming device so that approach/separation becomes free through a clutch changeover spring depending on a manual operation of a looper threading/stitch forming changeover manual operating portion and that the approach/separation state is held and the power from the sewing machine motor is transmitted.

In the gas carrying threading device of sewing machine of the present invention, the looper thread guide outlet and the looper thread inlet are equipped with a threading connecting device which is disposed so that approach/separation becomes free respectively at the time of the looper threading and at the time of the stitch formation depending on the manual operation of the looper threading/stitch forming changeover manual operating portion.

In the gas carrying threading device of sewing machine of the present invention, a positioning device which connects the looper thread guide outlet of the hollow looper thread guide and the looper thread inlet of the looper by rotating a pulley which is fixed at one end of the drive shaft manually when the looper thread guide outlet and the looper thread inlet are aligned horizontally is equipped.

In the gas carrying threading device of sewing machine of the present invention, at the time of the looper threading, the looper threading/stitch forming changeover mechanism has the means which changes over the clutch so that the power is transmitted to the gas supply pump, the means that the positioning of the positioning device which connects the looper thread guide outlet of the hollow looper thread guide and the looper thread inlet of the looper is prepared, the connection of the threading connecting device which is disposed so that approach/separation becomes free respectively at the time of the looper threading and at the time of the stitch formation is prepared, the positioning device operates and the transmission of the power to the stitch forming device is interrupted by rotating manually the pulley which is fixed at one end of the drive shaft, the threading connecting device operates and the looper thread guide outlet and the looper thread inlet are connected, and at the time of the stitch formation, has the means which changes over the clutch so that the power is transmitted to the stitch forming device, and the means which releases the positioning of the positioning device, releases the connection of the threading connecting device and separates the looper thread guide outlet and the looper thread inlet.

In the gas carrying threading device of sewing machine of the present invention, the positioning device has a stop positioning plate which is coaxially attached at the drive shaft and has a notch at the stop position of the circumferential direction for aligning the positions of the looper thread guide outlet, a thread take-up lever hole which is formed at a looper take-up lever and the looper thread inlet horizontally, and a positioning pin which fits to the notch by rotating the pulley manually at the time of the looper threading that the looper threading/stitch forming changeover manual operating portion is changed over to the looper threading side and operated manually.

A gas carrying threading device of sewing machine of the present invention is equipped with at least one looper which has a hollow structure from a looper thread inlet to a looper loop-taker point thread outlet, a looper thread introduction mechanism which inserts a looper thread which is led to the looper, a hollow looper thread guide which extends from the looper thread introduction mechanism to the looper thread inlet and has a looper thread guide outlet, a gas supply pump that a looper threading of the looper thread, is performed from the looper thread introduction area to the looper thread guide outlet through the hollow looper thread guide by the gas carrying, a clutch for respectively transmitting power from the sewing machine motor to a drive shaft which drives a stitch forming device including the looper at the time of the stitch formation or to the gas supply pump at the time of the looper threading, and a looper threading/stitch forming changeover mechanism for changing over the clutch so that the transmission of the power to the stitch forming device is interrupted and the power is transmitted to the gas supply pump at the time of the looper threading and so that the power is transmitted to the stitch forming device and the transmission of the power to the gas supply pump is interrupted at the time of the stitch formation. The looper threading/stitch forming changeover mechanism has a clutch changeover transmitter which changes over the clutch so that the power is transmitted to the gas supply pump at the time of the looper threading, a positioning device which has a stop positioning plate which is coaxially attached at the drive shaft and which has a notch at a stop position of a circumferential direction for aligning the positions of the looper thread guide outlet and the looper thread inlet horizontally and which has a positioning pin which connects a threading connecting device which can fit to the notch by rotating the pulley manually at the time of the looper threading and which is disposed so that approach/separation becomes free at the time of the looper threading and at the time of the stitch formation respectively, a pin advance/retreat cam for advancing and retreating the positioning pin for the stop positioning plate and connecting the threading connecting device, and a releasing can for separating the looper thread guide outlet and the looper thread inlet by releasing the threading connecting device.

In the gas carrying threading device of sewing machine of the present invention, a clutch changeover restriction mechanism for avoiding the transition of the looper threading/stitch forming changeover mechanism from the looper threading state to the stitch forming state during gas supply operation of the gas supply pump is equipped.

In the gas carrying threading device of sewing machine of the present invention, during gas supply operation of the gas supply pump, the clutch changeover restriction mechanism has a pneumatic actuator that the gas is supplied from the gas supply pump and a connecting device for avoiding the transition of the looper threading/stitch forming changeover mechanism from the looper threading state to the stitch forming state by the gas supply of the pneumatic actuator.

In the gas carrying threading device of sewing machine of the present invention, the pneumatic actuator has a piston cylinder that a piston performs the operation of the elongation by the gas supply of the gas supply pump and a retarder which delays the gas of the inside of the pneumatic actuator and exhausts the gas by spending time little by little after the gas from the gas supply pump is not supplied.

In the gas carrying threading device of sewing machine of the present invention, the pneumatic actuator has a spring which deviates the pneumatic actuator to the retreated original position and accelerates the exhaust of the retarder.

Effect of the Invention

According to the gas carrying threading device of sewing machine of the present invention, in the insertion operation of the looper thread to the looper, when inserting the looper thread from the thread introducing part, the thread introduction of the looper thread can be performed certainly by the looper thread introduction mechanism.

Besides, according to the gas carrying threading device of sewing machine of the present invention, the pressurized gas for the gas carrying of the looper thread is produced by a gas supply pump which is operated by the sewing machine motor, and the threading to the looper can be performed by one-touch operation.

Further, according to the gas carrying threading device of sewing machine of the present invention, the looper threading changeover operation can be performed in one hand by the looper threading/stitch forming changeover mechanism.

Therefore, according to the gas carrying threading device of sewing machine of the present invention, by connecting with the hollow thread guide which leads from the thread outlet of the loop-taker point of the looper to the thread introducing part which inserts the thread, the complicated thread guard is unnecessary and the threading that the handleability is easy can be performed. And, there are no mistake of the threading, no protrusion of the thread in mid-process, and no entanglement of the inserted looper thread with other thread. And because the thread is supplied by utilizing the flow of the pressurized gas which is supplied to the hollow thread guide means, the threading can be performed at once by the extremely easy operation.

Besides, according to the gas carrying threading device of sewing machine of the present invention, because a particular changeover operation from a looper threading state to a stitch forming state is not performed by a clutch changeover restriction mechanism, a changeover from the looper threading state to the stitch forming state can be performed normally without causing the difficult point that a looper thread inlet and a thread take-up lever hole which is formed at a looper thread take-up lever do not align at the looper thread guide outlet horizontally.

BRIEF DESCRIPTION OF THE DRAWINGS

FIG. 5 (B) An exploded perspective view showing a positioning device which is used in a gas carrying threading device of sewing machine by the present invention.

-FIG. 19 is incorporated in a looper threading/stitch forming changeover mechanism.

MODE FOR CARRYING OUT THE INVENTION

Hereinafter the preferable embodiment that the gas carrying threading device of sewing machine of the present invention is applied to the three-needle/six-thread serger (double chain stitch sewing machine) is explained in detail by referring to the views.

Figure 1:
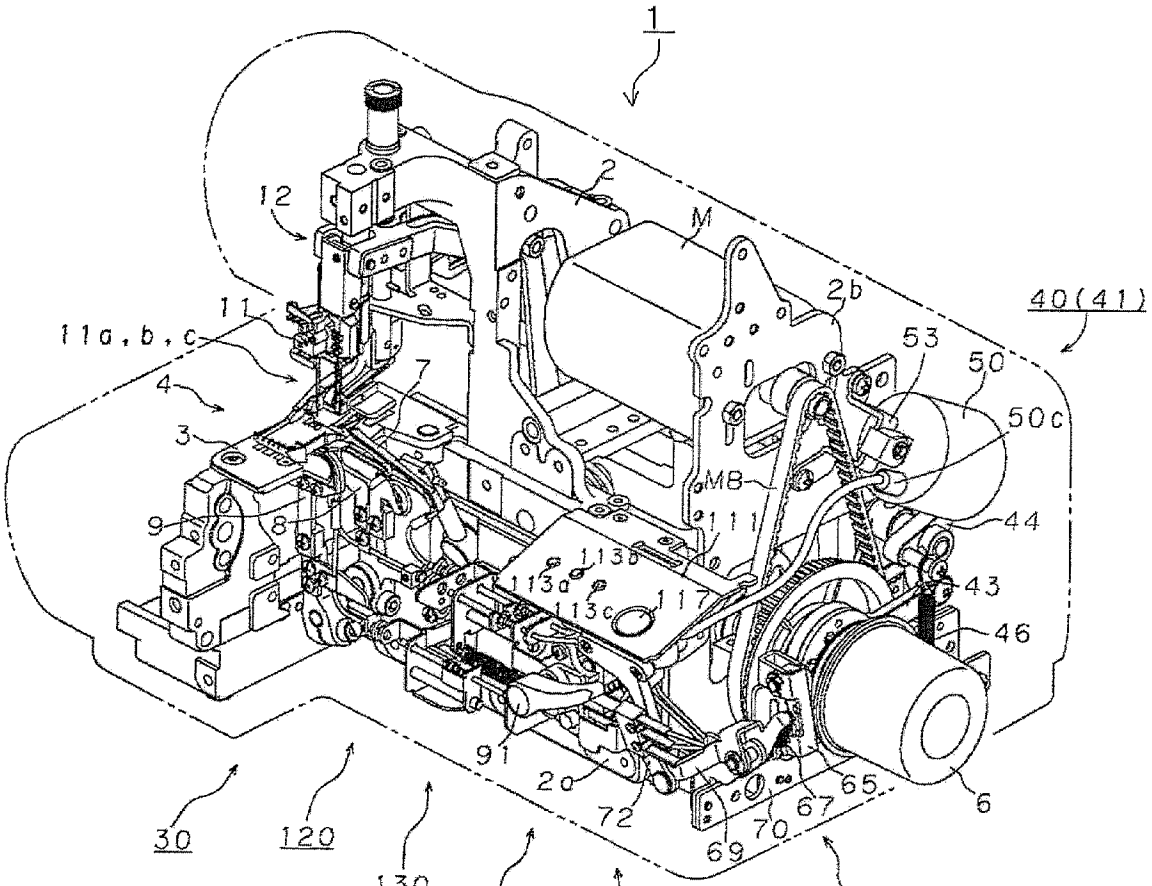
FIG. 1 A perspective view of a three-needle/six-thread serger (double chain stitch sewing machine) applying a gas carrying threading device of sewing machine by the present invention.

As shown in FIG. 1, this serger 1 is composed from a main frame 2 which forms a bed and an arm. The main frame 2 has a sub-frame 2*a* and a sub-frame 2*b*.

The sewing machine motor M is attached to the sub-frame 2*b*, and a drive shaft 5 lengthens along the frame 2 in a horizontal direction (FIG. 2, FIG. 7-FIG. 9, FIG. 12-FIG. 13). As described below, the drive shaft 5 is rotated and driven through a clutch 60 by using a timing belt MB by the sewing machine motor M.

Figure 2:
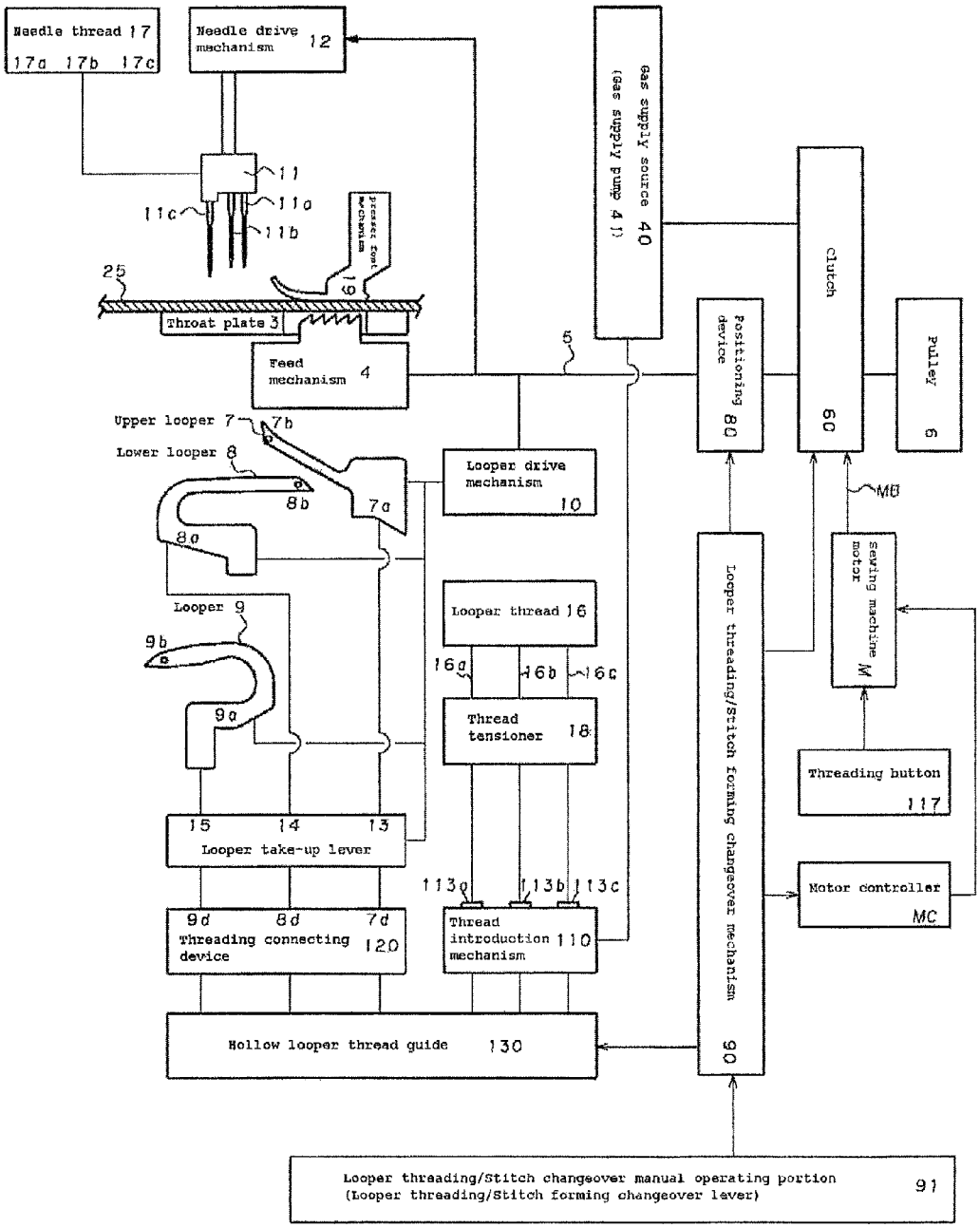
FIG. 2 A block diagram of a three-needle/six-thread serger (double chain stitch sewing machine) applying a gas carrying threading device of sewing machine by the present invention.

As shown in FIG. 1 and FIG. 2, a stitch forming device 30 is formed by needle 11*a*, 11*b*, 11*c* which perform vertical motion by being fixed at a needle clamp 11 which performs the vertical motion in synchronization with the drive shaft 5 and piercing a throat plate 3, a needle drive mechanism 12 which drives these needle 11*a*, 11*b*, 11*c*, a presser foot mechanism 19 which presses a cloth 25 on the throat plate 3, a lower looper 8 which reciprocates by tracing arc-like trajectory so as to cross a trajectory of the needle 11*a*, 11*b*, 11*c* beneath the throat plate 3, an upper looper 7 which reciprocates by tracing elliptical trajectory so as to cross the trajectory of the lower looper 8 at the side of the throat plate 3 and cross the trajectory of the needle 11*a*, 11*b*, 11*c* above the throat plate 3, a looper 9 and a cloth feed mechanism 4 which forwards the cloth 25 every one stitch.

The upper looper 7, the lower looper 8 and the looper 9 are driven respectively by a looper drive mechanism 10.

The needle drive mechanism 12, the cloth feed mechanism 4 and the looper drive mechanism 10 of the stitch forming device 30, are driven by the drive shaft 5. However, because the concrete structure and the operation are publicly known or well known, the detailed explanation is omitted.

According to the three-needle/six-thread serger 1, an overlock stitch is formed on the cloth 25 by crossing needle thread 17*a*, 17*b* which is inserted to the needle 11*a*, 11*b*, a lower looper thread 16*b* which is inserted to the lower looper 8 and an upper looper thread 16*a* which is inserted to the upper looper 7. In addition, the looper 9 forms a 401 type stitch (double chain stitch) on the cloth 25 by crossing a looper thread 16*c* which is inserted to it and the needle thread 17*c* which is inserted to the needle 11*c*, and performs a so-called interlock stitch.

Figure 4A:
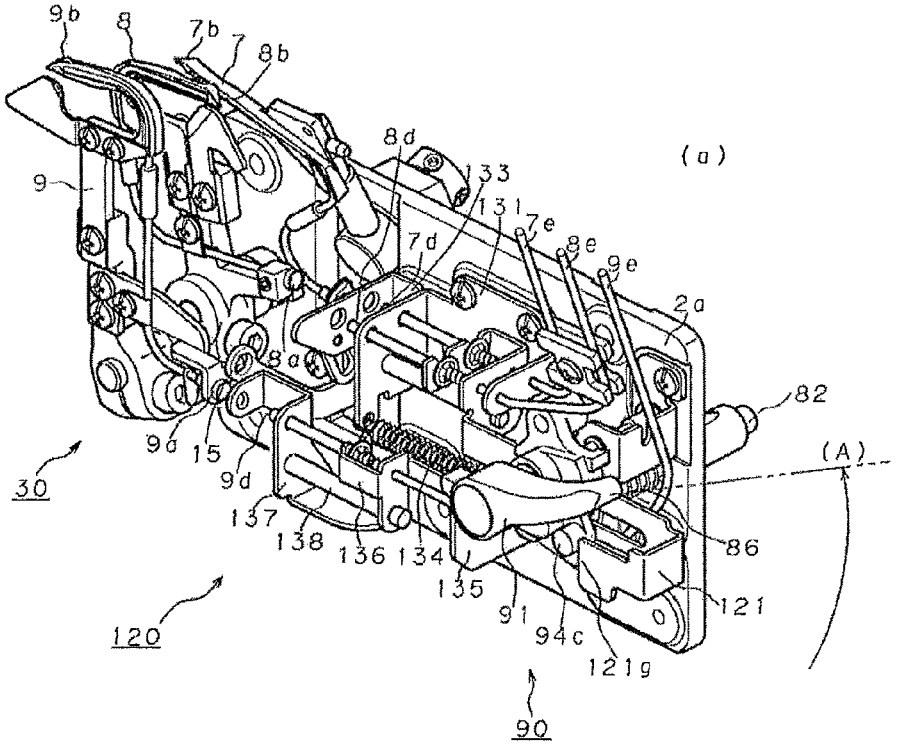
FIG. 4 A perspective view showing a threading connecting device, a hollow looper thread guide, and a looper threading/stitch forming changeover mechanism which are used in a gas carrying threading device of sewing machine by the present invention, and (*a*) is a stitch forming state and (*b*) is a threading state.
Figure 4B:
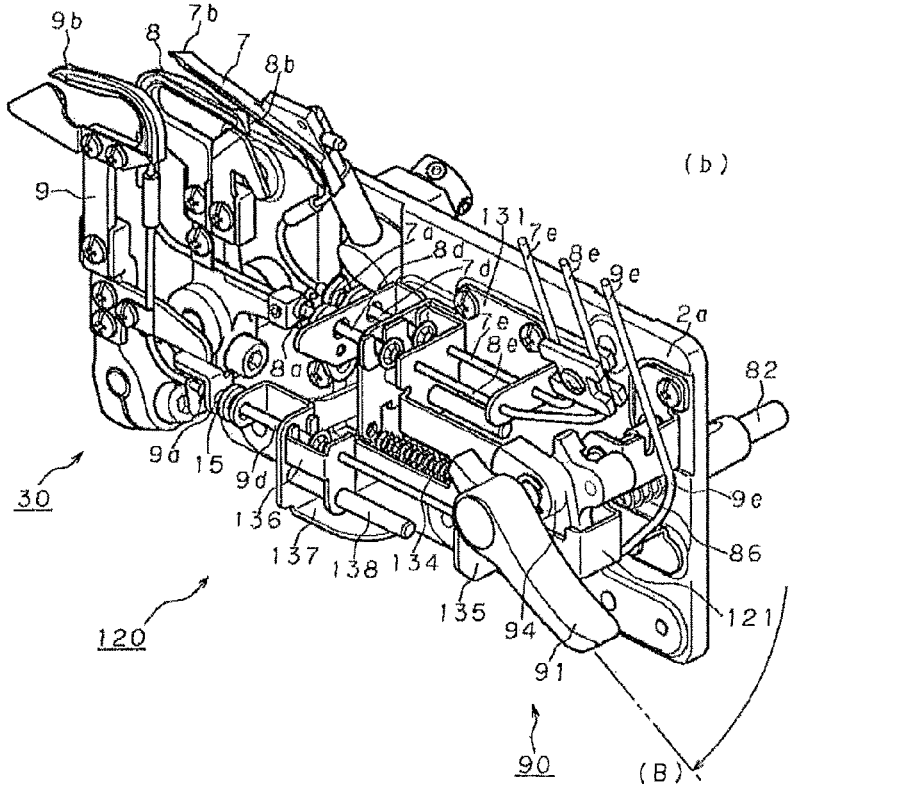
Figure 5A:
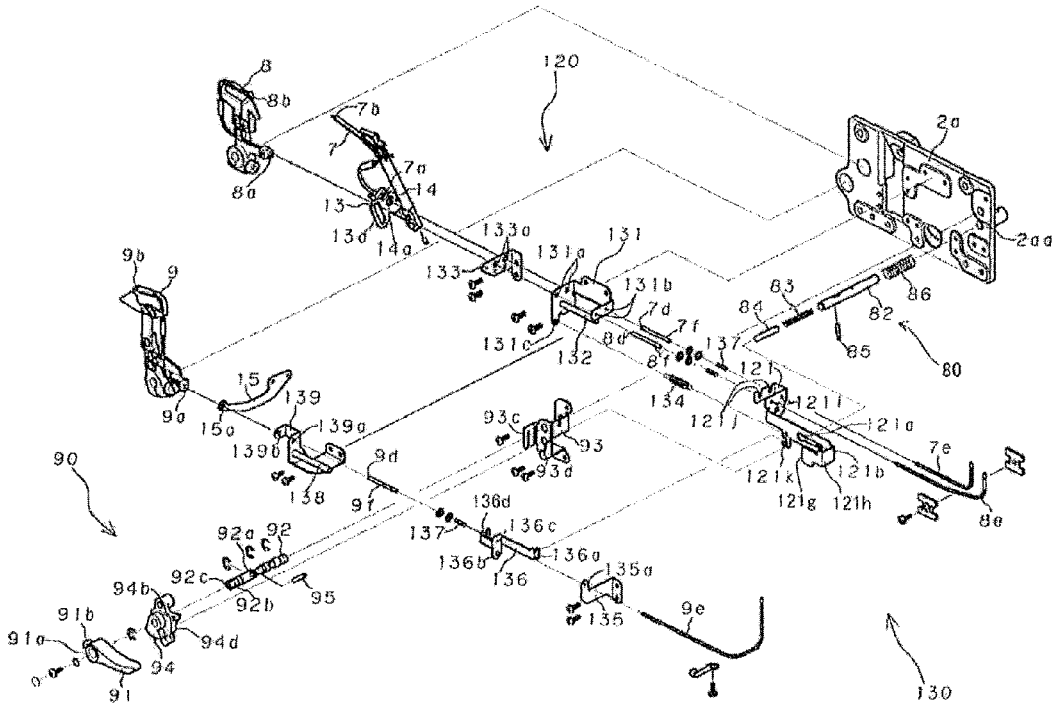
FIG. 5 (A) An exploded perspective view showing a threading connecting device, a hollow looper thread guide, and a looper threading/stitch forming changeover mechanism which are used in a gas carrying threading device of sewing machine by the present invention.
Figure 5B:
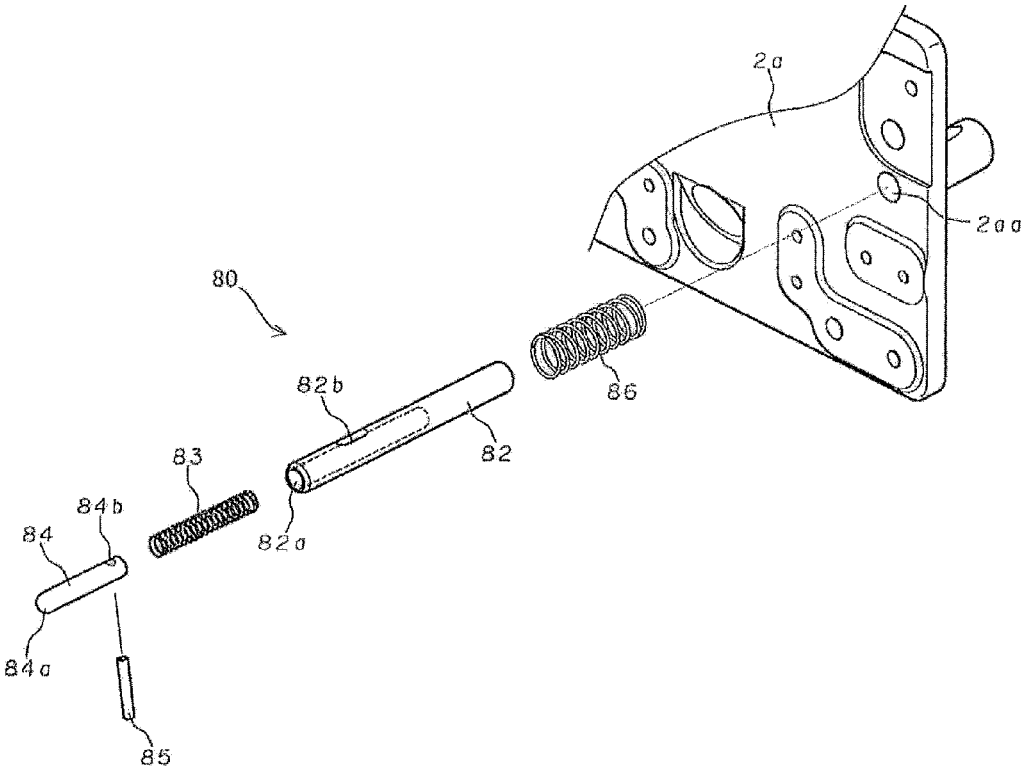

In this serger 1, when performing the looper threading to the upper looper 7, the lower looper 8 and the looper 9 by a gas carrying through a thread tensioner 18 concerning each looper thread 16*a*, 16*b*, 16*c*, the upper looper 7, the lower looper 8 and the looper 9 are a hollow structure from a looper thread inlet 7*a*, 8*a*, 9*a* to looper loop-taker point thread outlet 7*b*, 8*b*, 9*b* (FIG. 4 (*a*), (*b*), FIG. 5 (A)). Here, "hollow structure" may compose the looper itself as the hollow structure from the looper thread inlet 7*a*, 8*a*, 9*a* to the looper loop-taker point thread outlet 7*b*, 8*b*, 9*b*, and may compose the structure that a groove is formed in the looper from the looper thread inlet 7*a*, 8*a*, 9*a* to the looper loop-taker point thread outlet 7*b*, 8*b*, 9*b*, and that a hollow pipe is embedded in there. In this case, a cross-section of the structure may be a circle or a polygon, and for example, the cross-section may be C-shape that a part lacks.

Figure 3A:
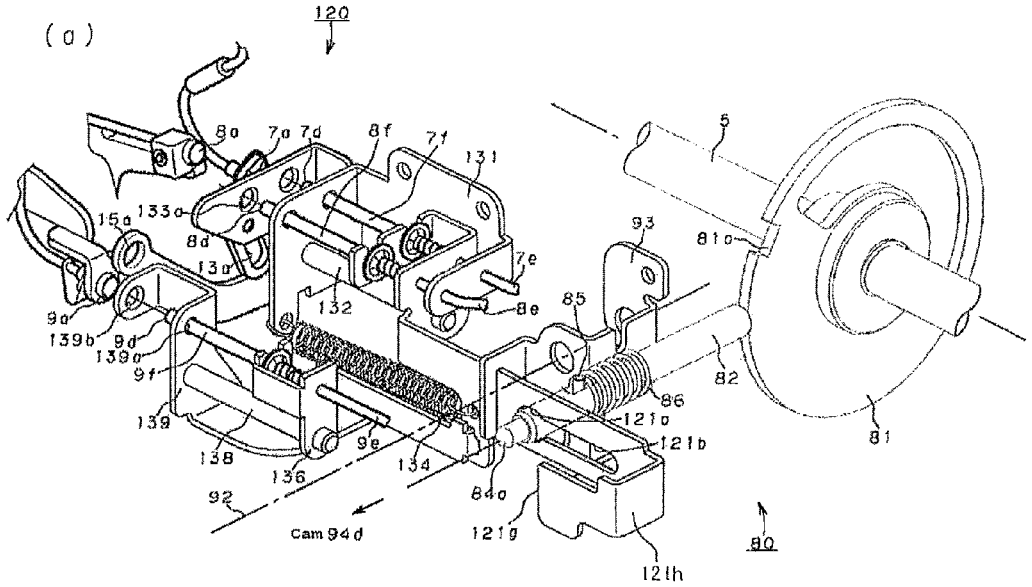
FIG. 3 A partial perspective view showing a threading connecting device, a hollow looper thread guide, and a looper threading/stitch forming changeover mechanism which are used in a gas carrying threading device of sewing machine by the present invention, and (*a*) is a threading preparatory state and (*b*) is a threading state.
Figure 3B:
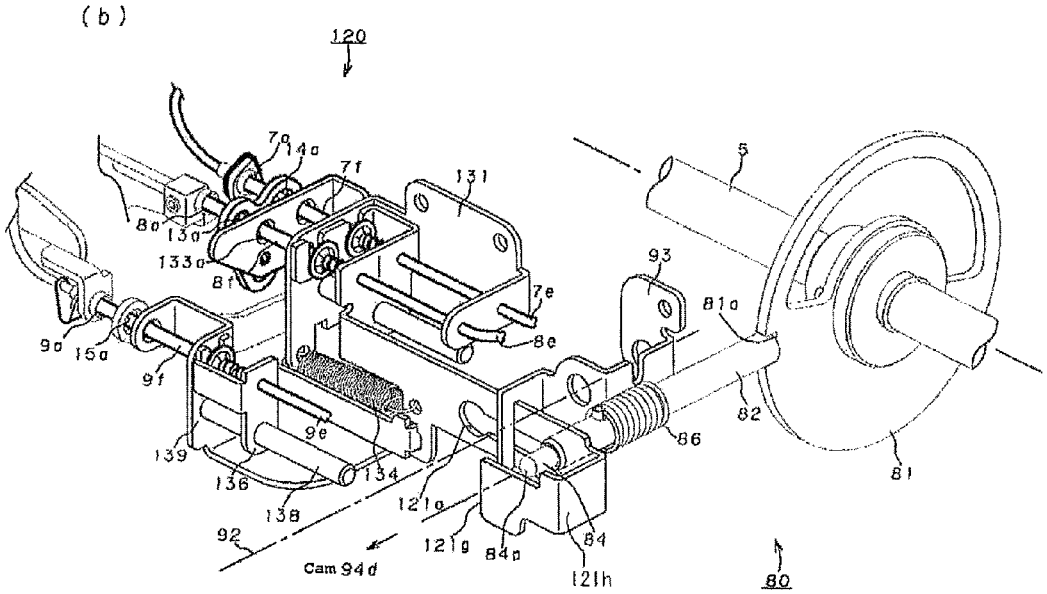
Figure 6:
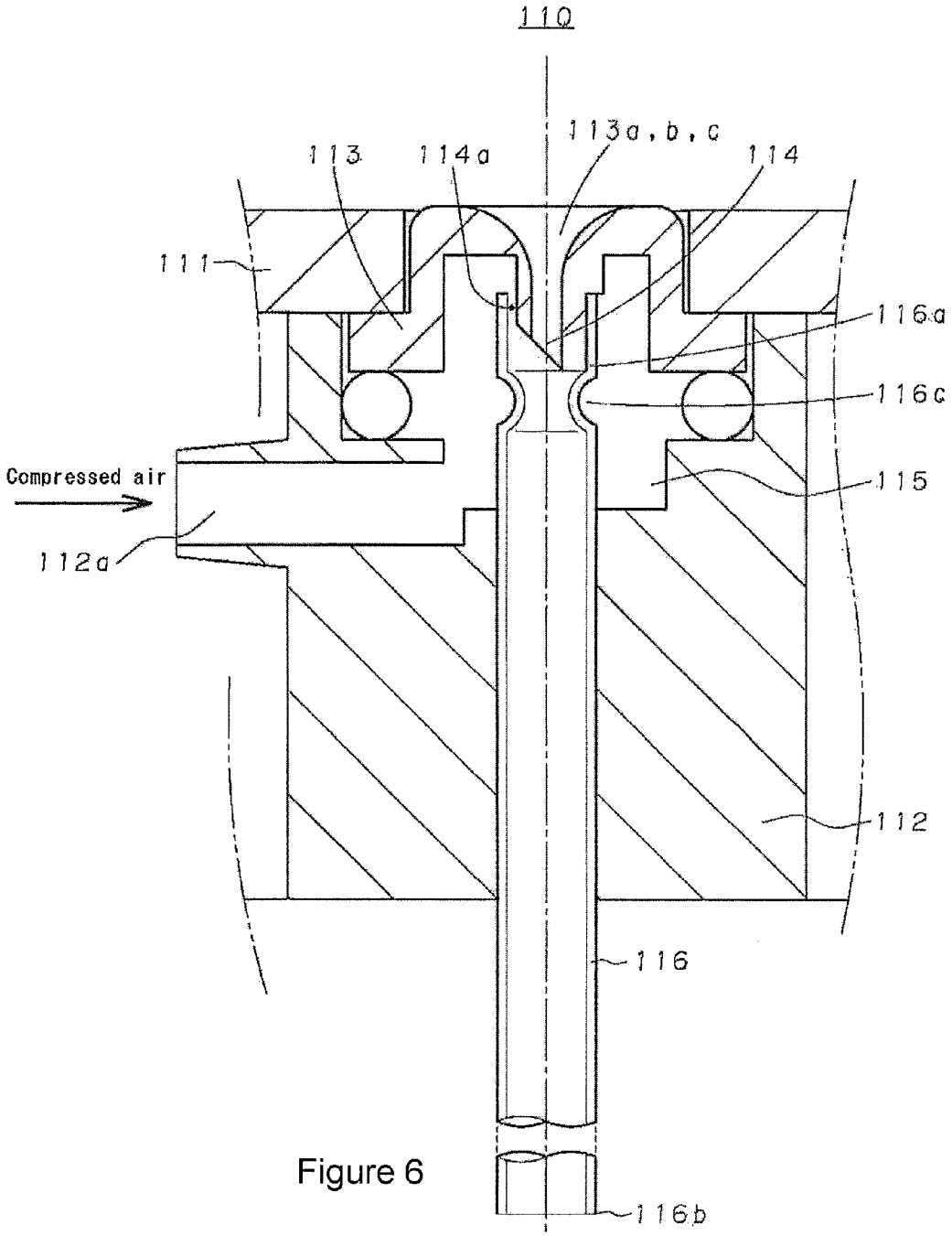
FIG. 6 An explanatory view showing a looper thread introduction mechanism which is used in a gas carrying threading device of sewing machine by the present invention.
Figure 7:
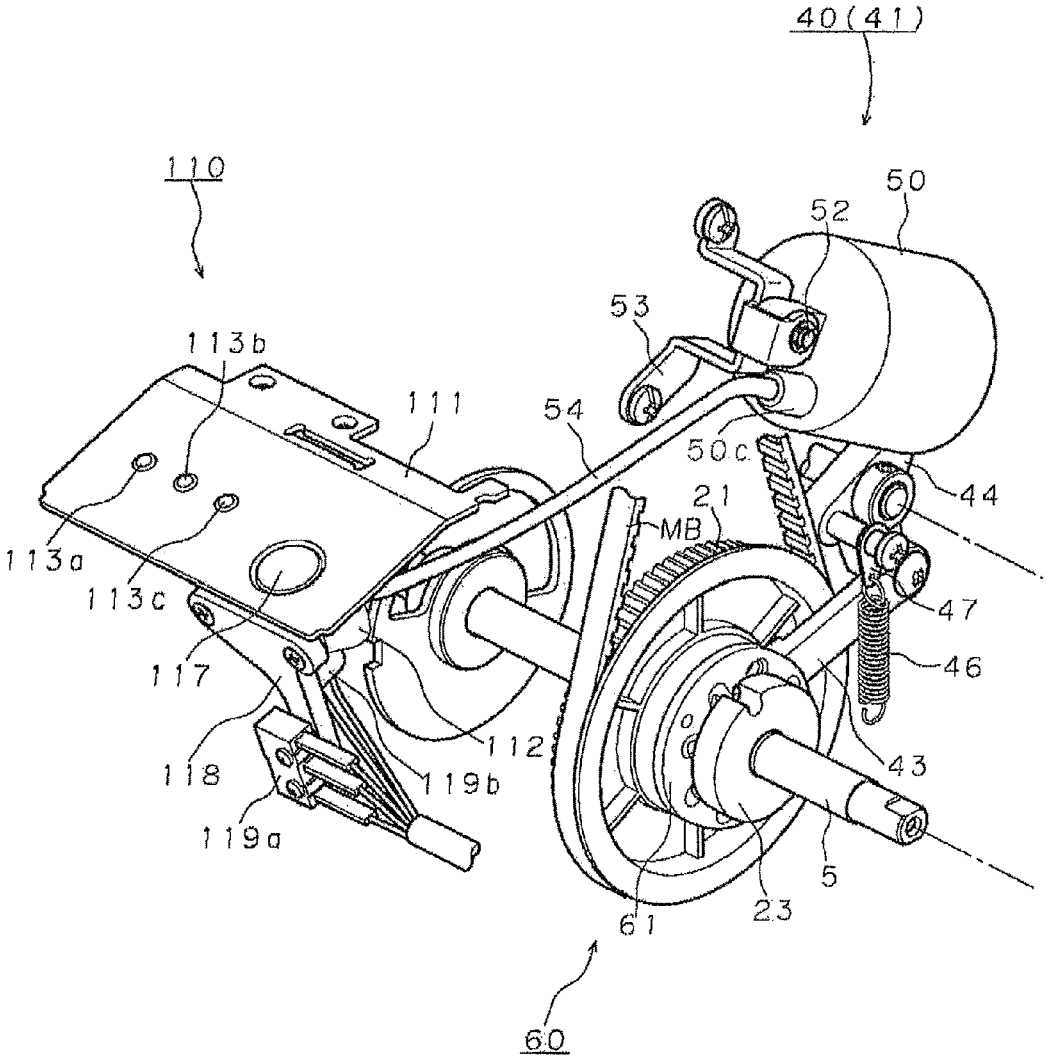
FIG. 7 A perspective view showing a gas supply pump and a looper thread introduction mechanism that a gas is supplied thereby which are used in a gas carrying threading device of sewing machine by the present invention.
Figures 8A, 8B:
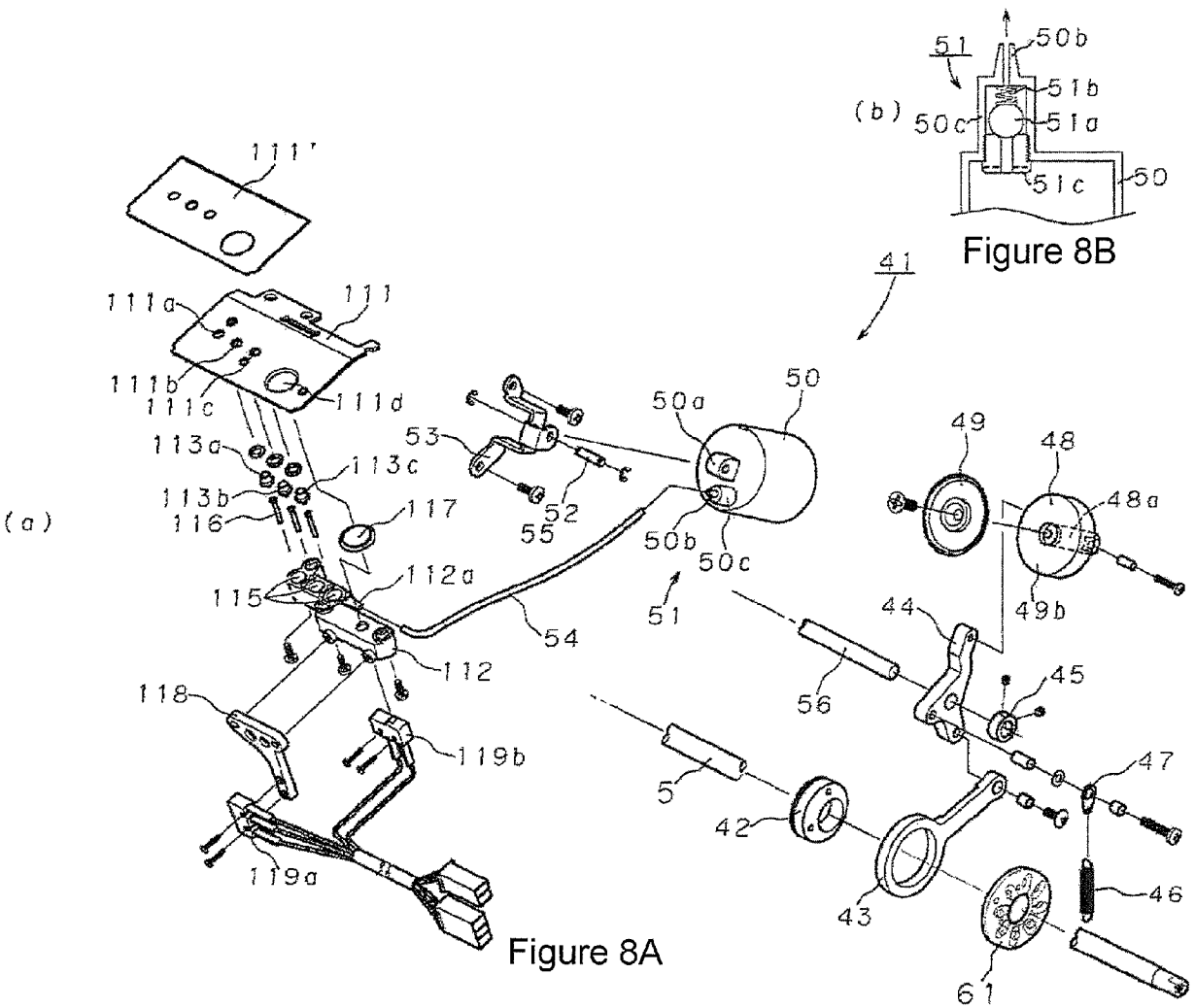
FIG. 8 (*a*) is an exploded perspective view showing a clutch, a gas supply pump which is driven through a clutch and a looper thread introduction mechanism that a gas is supplied by a gas supply pump which are used in a gas carrying threading device of sewing machine by the present invention. (*b*) is an explanatory view of a back flow stopper valve which is used in a gas supply pump.

For this purpose, the serger 1 is equipped with the looper thread introduction mechanism 110 which inserts each looper thread which is led to the upper looper 7, the lower looper 8 and the looper 9, the hollow looper thread guide 7*e*, 8*e*, 9*e* which extends from the looper thread introduction mechanism 110 to the looper thread inlet 7*a*, 8*a*, 9*a* and has the looper thread guide outlet 7*d*, 8*d*, 9*d* and a gas supply source 40 that the looper threading of each looper thread is performed from the looper thread introduction mechanism 110 to the looper thread guide outlet 7*d*, 8*d*, 9*d* through the hollow looper thread guide 7*e*, 8*e*, 9*e* by the gas carrying (FIG. 1, FIG. 3 (*a*), (*b*), FIG. 4 (*a*), (*b*), FIG. 6, FIG. 7, FIG. 8).

As shown in FIG. 6, the looper thread introduction mechanism 110 has wide-mouthed looper thread insertion slot 113*a*, 113*b*, 113*c* which insert each looper thread and a looper thread inhalation area 114 which leads to the wide-mouthed looper thread insertion slots 113*a*, 113*b*, 113*c*, a gas buffer area 115 that the pressurized gas is supplied from the gas supply source 40 and a looper thread introduction pipe 116 which is fitted to the looper thread inhalation area 114 at one end part 116*a* and is connected to the hollow looper thread guide 7*e*, 8*e*, 9*e* at the other end part 116*b*.

The looper thread inhalation area 114 and the looper thread introduction pipe 116 form a ventilation narrow area 114*a* which leads to the gas buffer area 115 and generates a jet stream in a downstream portion of the looper thread inhalation area 114.

A looper thread guide outlet end 114*b* of the looper thread inhalation area 114 is formed slantingly, thereby the generation of a vortex flow is prevented in the downstream side of the ventilation narrow area 114*a*.

A bottleneck portion 116*c* is formed in the inside of the looper thread introduction pipe 116 which is adjacent to the looper thread inhalation area 114 in the downstream side of the ventilation narrow area 114*a*, and therefore, the gas flow in the ventilation narrow area 114*a* is promoted by reducing the pressure of the downstream side of the bottleneck portion 116*c* and the looper thread is inhaled into the looper thread introduction pipe 116 by generating the negative pressure in the looper thread introduction area 114, and the gas carrying can be performed to the looper thread loop-taker point outlet 7*b*, 8*b*, 9*b* of the upper looper 7, the lower looper 8 and the looper 9 through the hollow looper thread guide 7*e*, 8*e*, 9*e*.

As shown in FIG. 7 and FIG. 8, the looper thread introduction mechanism 110 is formed on a looper thread introduction pedestal 112. Besides, a threading button 117 is formed at the looper thread introduction pedestal 112. Looper thread inset slot 111*a*, 111*b*, 111*c* and a threading button hole 111*d* where the wide-mouthed looper thread insertion slot 113*a*, 113*b*, 113*c* and the threading button 117 face are provided at a thread insert plate 111, and is fixed at frame 2, and a thread inset plate seal 111' is pasted on that upper surface.

A threading switch 119*b* which operates by the push of the threading button 117 is provided on the looper thread introduction pedestal 112 together with an after-mentioned looper threading/stitch forming changeover switch 119*a* which operates by the operation of a looper threading/stitch forming changeover manual operating portion 91 of a looper threading/stitch forming changeover mechanism 90 (FIG. 7).

As described below, the looper thread guide outlet 7*d*, 8*d*, 9*d* and the looper thread inlet 7*a*, 8*a*, 9*a* are disposed at the time of the looper threading and at the time of the sewing by the sewing machine so that approach/separation becomes free respectively.

Next, the other embodiment that the gas carrying threading device of sewing machine of the present invention is applied to the three-needle/six-thread serger (double chain stitch sewing machine) is explained.

In the serger 1 in this embodiment, as described below, the looper threading and the sewing by sewing machine are performed by utilizing the upper looper 7, the lower looper 8 and the looper 9 which are the hollow structures from the above-mentioned looper thread inlet 7*a*, 8*a*, 9*a* to the looper loop-taker point thread outlet 7*b*, 8*b*, 9*b*, the looper thread introduction mechanism 110 which inserts the looper thread which is led to the upper looper 7, the lower looper 8 and the looper 9, and the hollow looper thread guide 7*e*, 8*e*, 9*e* which extends from the looper thread introduction mechanism 110 to the looper thread inlet 7*a*, 8*a*, 9*a* and has the looper thread guide outlet 7*d*, 8*d*, 9*d*.

As shown in FIG. 1 and FIG. 2, the serger 1 is equipped with the gas supply pump 41 which is the gas supply source 40 that the looper threading is performed in each looper thread by the gas carrying from the looper thread introduction mechanism 110 to the looper thread guide outlet 7*d*, 8*d*, 9*d* through the hollow looper thread guide 7*e*, 8*e*, 9*e*, the clutch 60 for respectively transmitting the power from the sewing machine motor M to the drive shaft 5 which drives the stitch forming device 30 including the upper looper 7, the lower looper 8 and the looper 9 at the time of the stitch formation or to the gas supply pump 41 at the time of the looper threading, and the looper threading/stitch forming changeover mechanism 90 for changing over the clutch 60 so that the transmission of the power to the stitch forming device 30 is interrupted and the power is transmitted to the gas supply pump 41 at the time of the looper threading and the power is transmitted to the stitch forming device 30 and the transmission of the power to the gas supply pump 41 is interrupted at the time of the stitch formation.

As shown in FIG. 8, at the time of the looper threading, the gas supply pump 41 comprises a piston 48 which reciprocate by a pump drive arm 44 which is supported by a thrust collar 45 because a pump drive rod 43 reciprocates by a pump drive (eccentric) cam 42 which is rotated by a pump drive member 61 of the clutch 60 (FIG. 7, FIG. 12), a piston cap 49, a pump cylinder 50 that these slide in the airtight state, and that back flow stopper valve 51. A cylinder attaching portion 50*a* is attached by a pump attaching pedestal 53 at the sub-frame 2*b* so that the swing is allowed by a cylinder attaching pin 52.

Figure 10A:
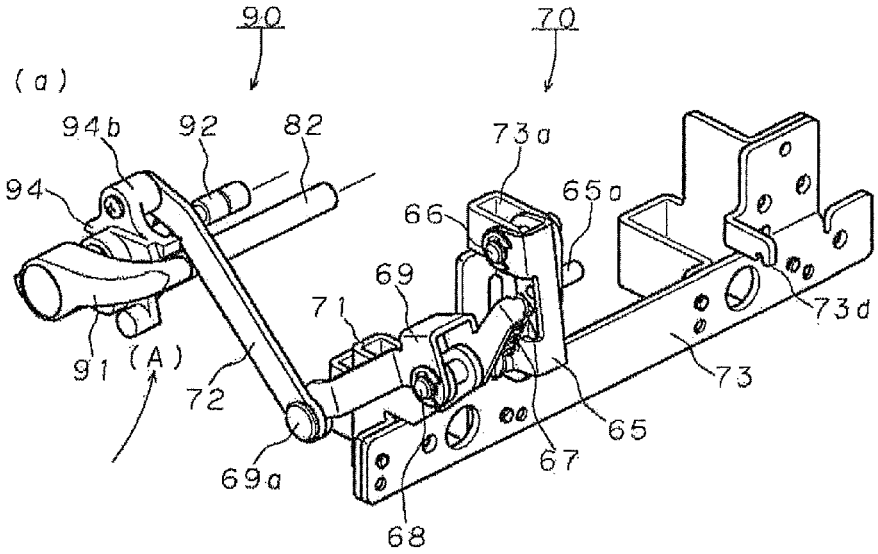
FIG. 10 (*a*), (*b*) are perspective views showing a looper threading/stitch forming changeover mechanism which is used in gas carrying threading device of sewing machine by the present invention at the time of a stitch formation and at the time of a looper threading respectively.
Figure 10B:
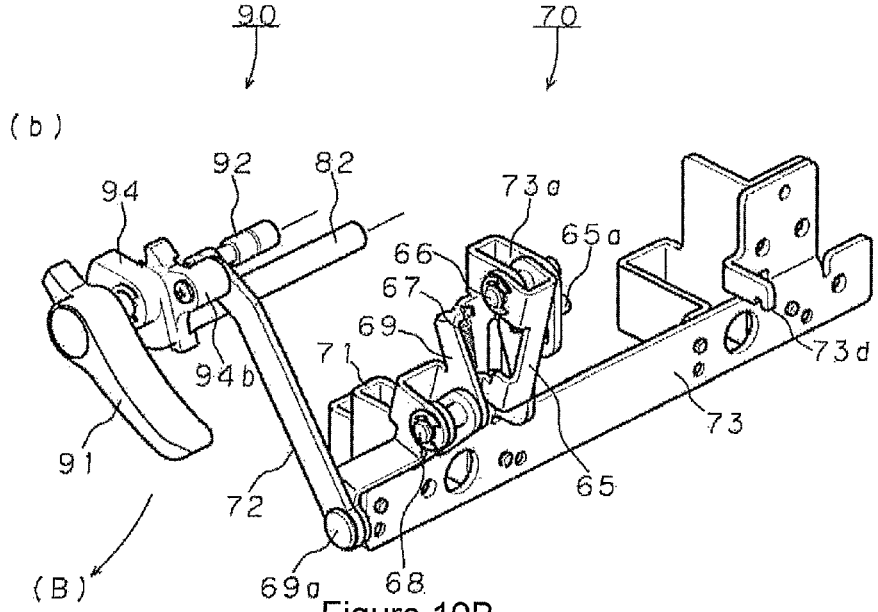
Figure 11B:
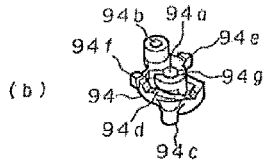
FIG. 11 (*a*) is an exploded perspective view showing a looper threading/stitch forming changeover mechanism and a clutch changeover transmitter which are used in gas carrying threading device of sewing machine by the present invention, (*b*) is a perspective view showing a looper threading/stitch forming changeover cam which is used in a looper threading/stitch forming changeover mechanism.
Figure 11A:
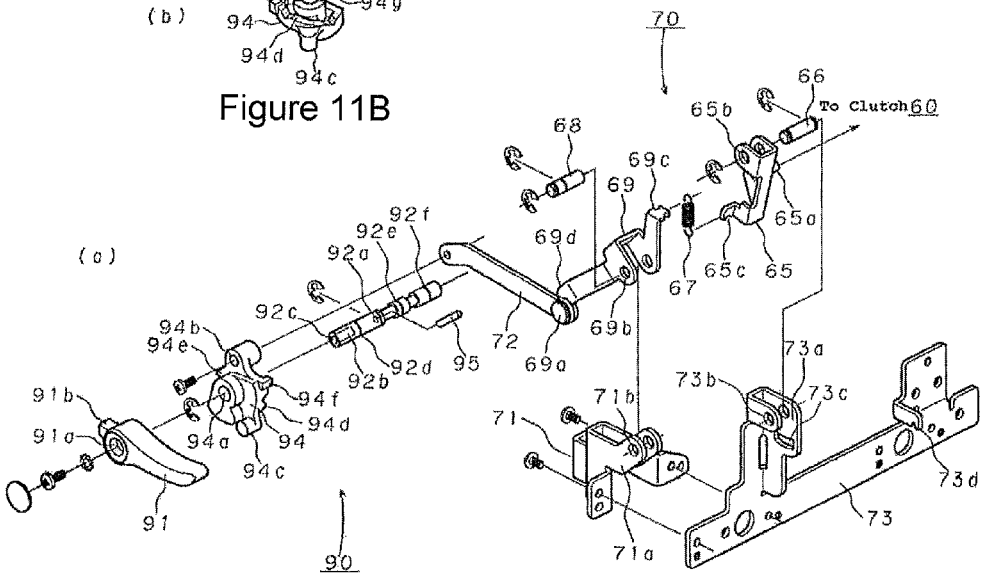

When the transmission of the power to the gas supply pump 41 is interrupted by stretching and providing a pump drive spring 46 to a spring stud 47 of the pump drive arm 44 and a spring stud 73*d* of a clutch changeover pedestal 73 (FIG. 10 (*a*), (*b*), FIG. 11), an idling of the pump drive (eccentric) cam 42 by the friction with a rotary drive member 23 which is always rotating is prevented, and the function which assists the piston 48 at the time of the pressurization (forward) process is accomplished.

The piston 48 is attached at a piston shaft 48*a* and the piston cap 49 which is formed with the folding-fan shape toward the discharge direction and is the seal material is fixed at a piston head portion 48*b*.

The back flow stopper valve 51 is equipped with a spring 51*b*, a back flow stopper ball 51*a* which is pressed by the spring 51*b*, and a valve seat 51*c* which is screwed at a valve housing 50*c* and closes the valve by seating the back flow stopper ball 51*a* by pressing the spring 51*b* at the time of the return (inhalation) process and opens the valve by floating the back flow stopper ball 51*a* by the delivery pressurized air at the time of the pressurization (forward) process in the valve housing 50*c* which is connected to the pump cylinder 50 and a delivery port 50*b*.

In the operation of the gas supply pump 41, concerning the forward process of the piston 48, the piston cap 49 is connected to the inner wall surface of the pump cylinder 50 in the airtight state, and the air is compressed, and pressurized and injected as the compressed air from the delivery port 50*b* to an air inlet 112*a* (FIG. 6, FIG. 8) of the looper thread introduction mechanism 110 through the pipe 54. On the other hand, in the return (inhalation) process of the piston 48, because the piston cap 49 is not connected to the inner wall surface of the pump cylinder 50 in the airtight state, the air is inhaled through the outer circumference of the piston 48 and the piston cap 49, and the back flow of the air which is sent from the delivery port 50*b* is prevented by the back flow stopper ball 51*a* of the back flow stopper valve 51.

Figure 12:
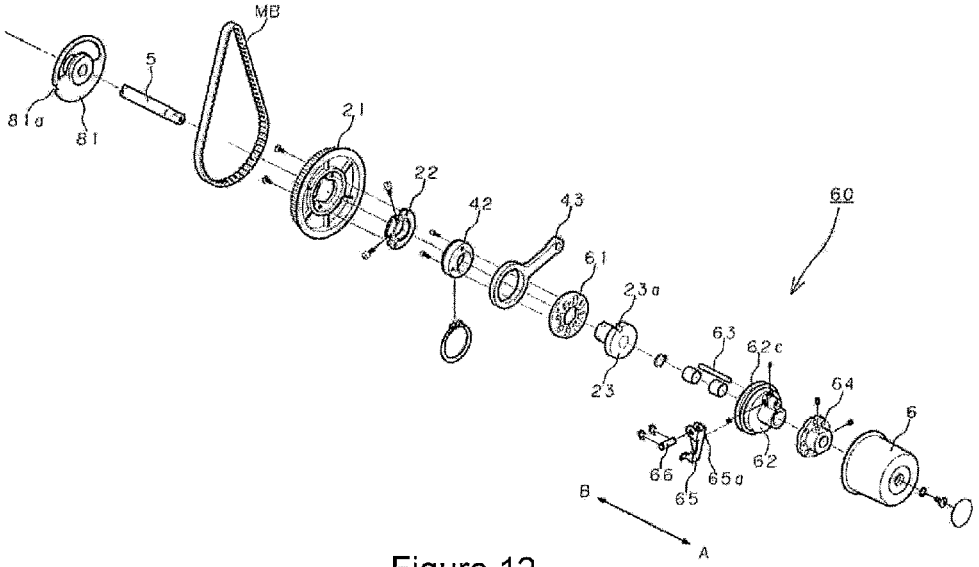
FIG. 12 An exploded perspective view showing a clutch and a positioning device which are used in gas carrying threading device of sewing machine by the present invention.

As shown in FIG. 1, FIG. 2 and FIG. 12, the clutch 60 has the pump drive member 61 which transmits the power to the gas supply pump 41, and a clutch slider 62 which is moved so that approach/separation becomes free through a clutch changeover spring 67 depending on a manual operation of a looper threading/stitch forming changeover manual operating portion (looper threading/stitch forming changeover manual lever) 91 to one of a stitch forming drive member 64 which is fixed to the one end of the drive shaft 5 and that the power is transmitted to the stitch forming device 30, and that the approach/separation state is held and the power from the sewing machine motor M is transmitted.

As discussed in detail, the clutch 60 is composed by so-called pin clutch, and a drive shaft pulley 21 that the power from the sewing machine motor M is transmitted by the timing belt MB, a drive shaft pulley boss 22, the pump drive (eccentric) cam 42, the pump drive member 61, the rotary drive member 23, the clutch slider 62 which houses a clutch connecting pin 63 inside coaxially and slidably, the stitch forming drive member 64 and a pulley 6 are provided in sequence on the shaft line of the drive shaft 5.

Figure 9A:
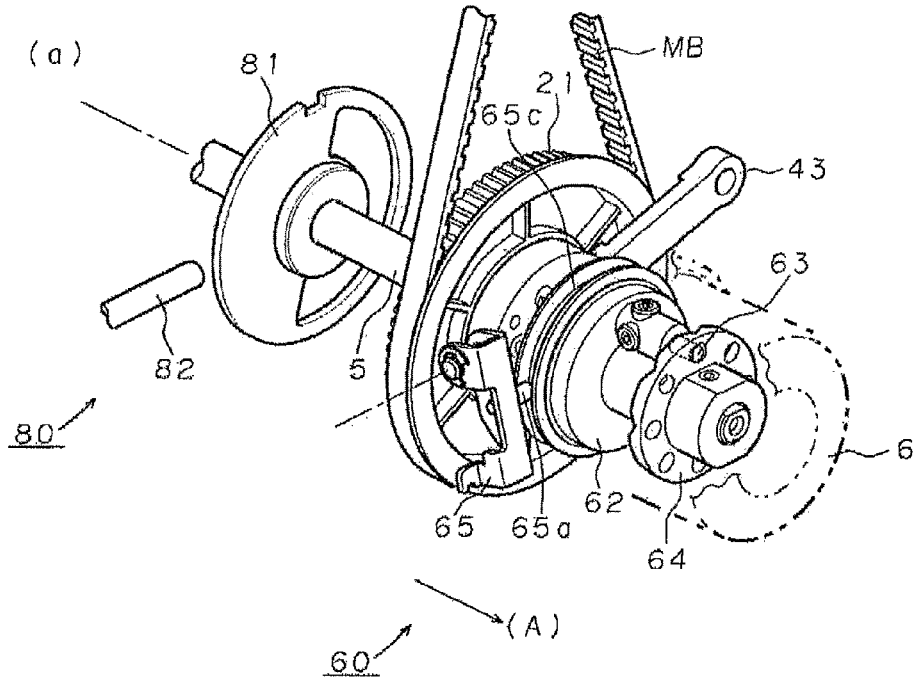
FIG. 9 (*a*), (*b*) are perspective views showing a clutch and a positioning device which are used in a gas carrying threading device of sewing machine by the present invention at the time of a stitch formation and at the time of a looper threading respectively.
Figure 9B:
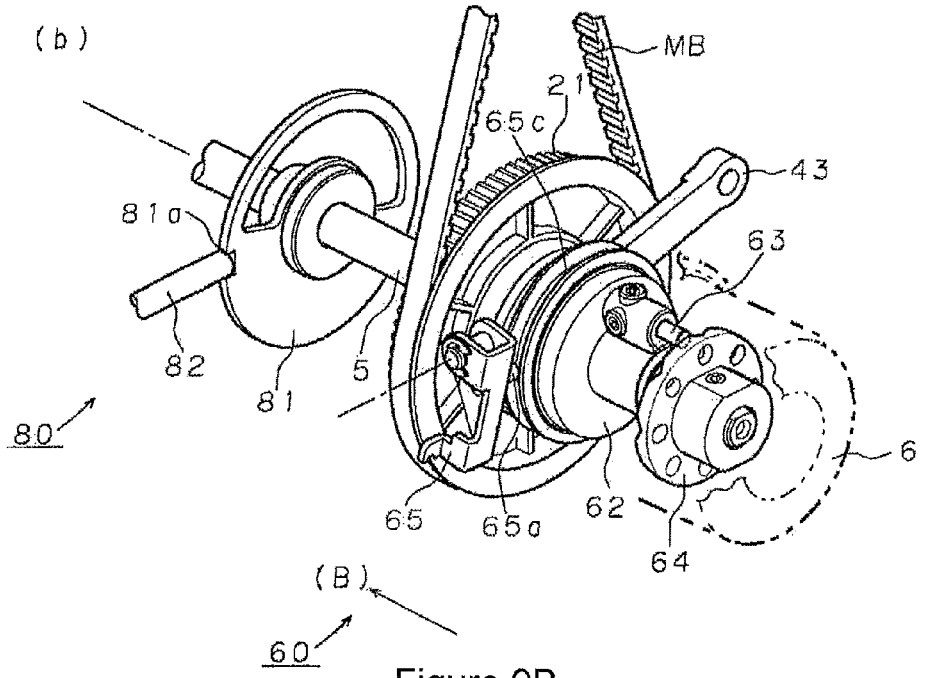

In the operation of the clutch 60 which is composed in this way, at the time of the looper threading, the clutch slider 62 slides to the pump drive member 61 side, and the clutch connecting pin 63 connects to a connecting pin hole of the pump drive member 61 with the rotary drive member 23, and the gas supply pump 41 can be driven by a pump drive rod 43 by the pump drive (eccentric) cam 42 (FIG. 9 (*b*)).

At the time of the stitch formation, the clutch slider 62 slides to the pulley 6 side, and the clutch connecting pin 63 connects to a connecting pin hole of the stitch forming drive member 64 with the rotary drive member 23, and the drive shaft 5 can be rotated (FIG. 9 (*a*)).

In the serger 1, as shown in FIG. 10 (*a*), (*b*) and FIG. 11, the looper threading/stitch forming changeover mechanism 90 has the clutch changeover transmitter 70 which changes over the clutch 60 so that the power is transmitted to the gas supply pump 41 at the time of the looper threading, that is, a looper threading/stitch forming changeover cam 94 which is rotated by the looper threading/stitch forming changeover manual operating portion (looper threading/stitch forming changeover manual lever) 91, a clutch changeover link 72 which is pivotally attached at a clutch changeover connecting arm 94*b* of the looper threading/stitch forming changeover cam 94 and swings, a clutch changeover lever 69 which swings by the clutch changeover link 72, a clutch changeover arm 65 which is screwed at the clutch changeover lever 69 by a swaging pin 69*a* and swings to the axial direction of the drive shaft 5 and a clutch changeover pin 65*a* which is fixed to the clutch changeover arm 65 and fits to a slider control groove 62*c* of the clutch slider 62 and changes over the clutch 60 by sliding the clutch slider 62 to the axial direction of the drive shaft 5 by the swing of the clutch changeover arm 65.

The looper threading/stitch forming changeover manual operating portion (looper threading/stitch forming changeover manual lever) 91 is screwed to a screw hole 92*c* by a screw so that the rotation is stopped in a rotary flatness portion 92*b* of one end portion of a changeover cam shaft 92 which is pivotally attached at the sub-frame 2*a* and a changeover cam shaft backup plate 93. The looper threading/stitch forming changeover cam 94 is fixed by fitting the pin 95 to the pin hole 92*a* of the changeover cam shaft 92.

The clutch changeover lever 69 is pivotally attached by a clutch changeover lever shaft 68 astride a clutch changeover lever attaching arm 71*a* of a clutch changeover lever supporting pedestal 71. The clutch changeover spring 67 is stretched and laid between a clutch changeover lever spring stud 69*c* of the clutch changeover lever 69 and a clutch changeover arm spring stud 65*c* of the clutch changeover arm 65.

The clutch changeover pin 65*a* which changes over the clutch 60 is implanted to the clutch changeover arm 65.

The clutch changeover lever supporting pedestal 71 is fixed to one end of the clutch changeover pedestal 73 which is fixed at the frame 2 through the clutch changeover pedestal 73.

In the clutch changeover arm 65, the clutch changeover arm attaching hole 65*b* is pivotally attached at a clutch changeover arm attaching hole 73*b* of a clutch changeover arm supporting pedestal 73*a* of the clutch changeover pedestal 73 by a clutch changeover lever shaft 66. A through-hole 73*c* that the clutch changeover pin 65*a* moves freely by allowing the swing of the clutch changeover pin 65*a* depending on the swing of the clutch changeover arm 65 is holed and provided at the clutch changeover pedestal 73.

Here, when rotating the looper threading/stitch forming changeover manual operating portion (looper threading/stitch forming changeover manual lever) 91 in a clockwise direction B (looper threading side), the clutch changeover lever 69 is driven by the clutch changeover link 72 and rotates in a counterclockwise direction, and the clutch changeover arm 65 is elastically repelled (stretched) by the clutch changeover spring 67, and one stable state is held by rotating in a clockwise direction. Therefore, the clutch slider 62 slides to the pump drive member 61 side by the clutch changeover pin 65*a*, and the clutch connecting pin 63 connects to the connecting pin hole of the pump drive member 61 by the rotary drive member 23, and the gas supply pump 41 can be operated and the looper threading can be performed (FIG. 9 (*b*) FIG. 10 (*b*)). And, the looper threading preparatory state of this clutch is held.

On the other hand, when rotating and returning the looper threading/stitch forming changeover manual operating portion (looper threading/stitch forming changeover manual lever) 91 in the counterclockwise direction A (stitch formation side), the clutch changeover lever 69 is driven by the clutch changeover link 72 and rotates in the clockwise direction, and the clutch changeover arm 65 is elastically repelled (stretched) by the clutch changeover spring 67, and the other stable state is held by rotating in the counterclockwise direction. The clutch slider 62 slides to the stitch forming drive member 64 side by the clutch changeover pin 65*a* by means of the clutch changeover spring 67, and the clutch connecting pin 63 connects to the connecting pin hole of the stitch forming drive member 64 by the rotary drive member 23, and the drive shaft 5 can be rotated and the stitch formation can be performed (FIG. 9 (*a*), FIG. 10 (*a*)). And, the stitch forming preparatory state of this clutch is held. That is, the clutch changeover spring 67 accomplishes the function which moves the clutch slider 62 to one of the pump drive member 61 which transmits the power to the gas supply pump 41 and the stitch forming drive member 64 which is fixed at one end of the drive shaft 5 and transmits the power to the stitch forming device 30 so that approach/separation becomes free depending on the manual operation of the looper threading/stitch forming changeover manual operating portion (looper threading/stitch forming changeover manual lever) 91 and which holds the approach/separation state.

Besides, the looper threading/stitch forming changeover cam 94 has a pin advance/retreat cam 94*d* for advancing and retreating an after-mentioned positioning pin for a stop positioning plate 81 and connecting a threading connecting device 120, and a releasing cam 94*c* for separating the looper thread guide outlet 7*d*, 8*d*, 9*d* and the looper thread inlet 7*a*, 8*a*, 9*a* by releasing the threading connecting device 120.

Besides, as shown in FIG. 3 (*a*), (*b*), FIG. 5 (A) and FIG. 11, the serger 1 is equipped with the threading connecting device 120 that the looper thread guide outlet 7*d*, 8*d*, 9*d* and the looper thread inlet 7*a*, 8*a*, 9*a* are disposed so that approach/separation becomes free respectively at the time of the looper threading and the stitch formation depending on the manual operation of the looper threading/stitch forming changeover manual operating portion 91.

In the threading connecting device 120, looper thread guide connecting plate 121, 136, looper thread guide outlet support 131, 139 and looper thread take-up lever thread guide 133, 139*b* are provided. These are fixed at the sub-frame 2*a*.

The hollow looper thread guide 7*e*, 8*e*, 9*e* of the hollow looper thread guide 130 which extends from the looper thread introduction mechanism 110 (FIG. 6) form looper thread passes through supporting hole 131*b*, 135*a*, supporting hole 121*i*, 136*c*, spring receiving groove 121*j*, 136*d*, supporting hole 131*a*, 139*a* and thread take-up lever thread guide 133*a*, 139*b* respectively by being inserted to the hollow looper thread guide 7*f*, 8*f*, 9*f* with nested state. Pressure-expanding spring 137 is provided between the supporting hole 121*i*, 136*c* and the spring receiving groove 121*j*, 136*d*, and is latched together at the spring receiving groove 121*j*, 136*d* by fastening ring, and the hollow looper thread guide 7*f*, 8*f*, 9*f* is elastically repelled to the looper side. Therefore, the hollow looper thread guide 7*f*, 8*f*, 9*f* is held slidably at the spring receiving groove 121*j*, 136*d* and the supporting hole 131*a*, 139*a* respectively, and the looper thread guide outlet 7*d*, 8*d*, 9*d* and the looper thread inlet 7*a*, 8*a*, 9*a* of the upper looper 7, the lower looper 8 and the looper 9 can approach and separate.

In addition, connecting plate guide bar 132, 138 which support the looper thread guide connecting plate 121, 136 is provided.

A spring 134 is stretched and provided between a spring stud 121*k* of the looper thread guide connecting plate 121 and a spring stud 131*c* of the looper thread guide outlet support 131, and thereby because the looper threading/stitch forming changeover manual operating portion (looper threading/stitch forming changeover manual lever) 91 is rotated to the clockwise direction B (looper threading side), the releasing cam 94*c* releases looper thread pass separated state through a cam follower 121*g* of the looper thread guide connecting plate 121, and when connecting the threading connecting device 120, the hollow looper thread guide 7*f*, 8*f*, 9*f* is elastically repelled to the looper side, and the looper thread guide outlet 7*d*, 8*d*, 9*d* and the looper thread inlet 7*a*, 8*a*, 9*a* are connected in the thread pass.

Figure 13A:
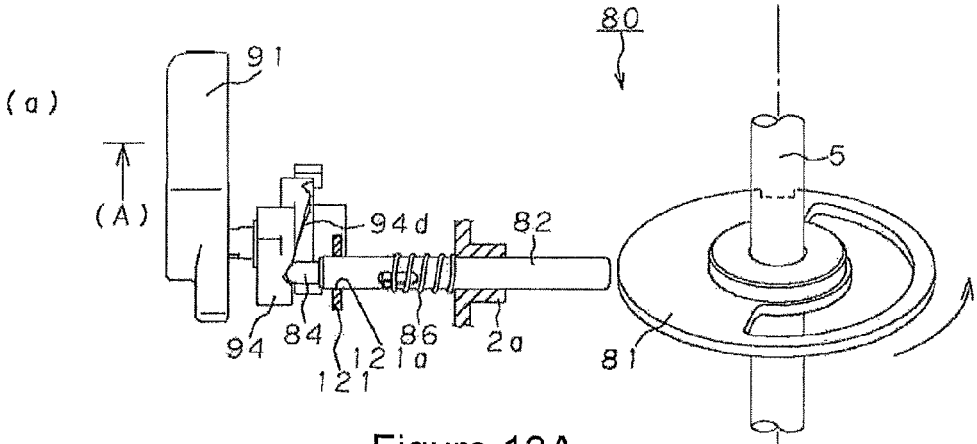
FIGS. 13 (*a*), (*b*) and (*c*) are perspective views showing a looper threading/stitch forming changeover mechanism and a positioning device which are used in gas carrying threading device of sewing machine by the present invention at the time of a stitch formation, at the time of a looper threading preparatory state and at the time of a looper threading respectively.
Figure 13B:
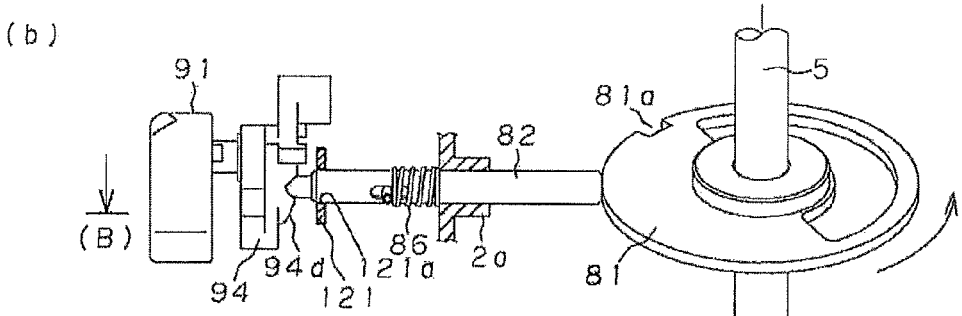
Figure 13C:
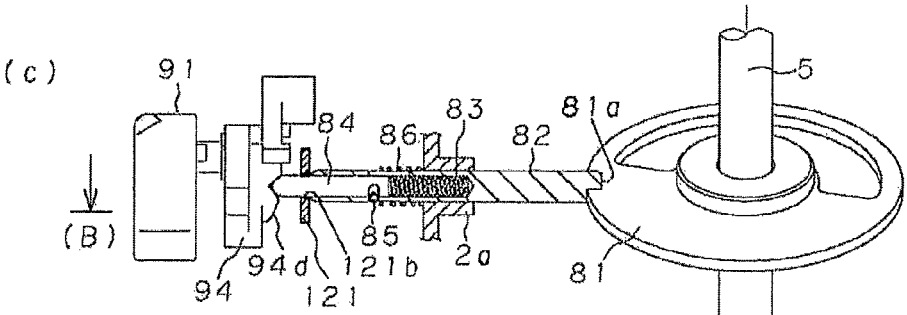

Besides, as shown in FIG. 2, FIG. 3 (*a*), (*b*) FIG. 4 (*a*), (*b*), FIG. 9 (*a*), (*b*), FIG. 12, FIG. 13 (*a*), (*b*), (*c*), the serger 1 is equipped with a positioning device 80 which functions as the safety device.

As shown in FIG. 3 (*a*), (*b*), FIG. 4 (*a*), (*b*), the positioning device 80 has the stop positioning plate 81 which is coaxially attached at the drive shaft 5 and has a notch 81*a* at the stop position of the circumferential direction for aligning the positions of the looper thread guide outlet 7*d*, 8*d*, 9*d* and the looper thread inlet 7*a*, 8*a*, 9*a* horizontally and the positioning pin 82 which connects the threading connecting device 120 which can fit to the notch 81*a* by rotating the pulley 6 manually at the time of the looper threading that the looper threading/stitch forming changeover manual operating portion (looper threading/stitch forming changeover manual lever) 91 is changed over and operated manually to the looper threading side and which is disposed so that approach/separation becomes free at the time of the looper threading and the stitch formation respectively (FIG. 5 (A), FIG. 5 (B)).

The positioning device 80 is equipped with a follower pin 84 which has a follower pin end 84*a* which engages to the pin advance/retreat cam 94*d* of the looper threading/stitch forming changeover cam 94 and the positioning pin 82 that the follower pin 84 is fitted in through a follower pin spring 83. The follower pin 84 becomes slidable by a guide pin 85 through the follower pin spring 83 in the inside of an elongate hole 82*b*. A positioning pin back spring 86 is provided between the guide pin 85 and the sub-frame 2*a* in the positioning pin 82, and the positioning pin 82 is elastically repelled toward the looper threading/stitch forming changeover cam 94.

The positioning pin 82 pierces a positioning pin slide hole 2*aa* and extends toward the positioning plate 81. The follower pin 84 and the positioning pin 82 that this fits are fitted in a shaft hole 121*a* leading to an elongate hole 121*b* of the looper thread guide connecting plates 121 with the looper thread pass separated state.

In this way, in the gas carrying threading device of sewing machine of the present invention, as the form in one viewpoint, it can be expressed that the looper threading/stitch forming changeover mechanism 90 has the means (the clutch changeover lever 69, the pin advance/retreat cam 94*d*, clutch changeover arm 65, the clutch changeover spring 67, the clutch changeover pin 65*a*) which changes over the clutch 60 so that the power is transmitted to the gas supply pump 41 at the time of the looper threading, and the means (the looper thread guide connecting plate 121, the hollow looper thread guide 7*e*, 8*e*, 9*e*, the hollow looper thread guide 7*f*, 8*f*, 9*f*, the spring 134, the follower pin 84, the positioning pin 82, the follower pin spring 83, the follower pin 84, the positioning pin back spring 86) that the positioning of the positioning device 80 which connects the looper thread guide outlet 7*d*, 8*d*, 9*d* of the hollow looper thread guide 130 and the looper thread inlet 7*a*, 8*a*, 9*a* of the looper is prepared, and the connection of the threading connecting device 120 which is disposed so that approach/separation becomes free at the time of the looper threading and at the time of the stitch formation respectively is prepared, and the positioning device 80 operates at the time that the looper thread inlet 7*a*, 8*a*, 9*a* and the thread take-up lever hole which is formed at the looper take-up lever which move respectively and differently by rotating manually the pulley 6 which is fixed at one end of the drive shaft 5 is aligned horizontally to the looper thread guide outlet, at the time, the transmission of the power to the stitch forming device 30 is interrupted, and the threading connecting device 120 operates, and the looper thread guide outlet 7*d*, 8*d*, 9*d* and the looper thread inlet 7*a*, 8*a*, 9*a* are connected.

Besides, in the gas carrying threading device of sewing machine of the present invention, as the form in one viewpoint, it can be expressed that the looper threading/stitch forming changeover mechanism 90 has the means (the clutch changeover lever 69, the clutch changeover arm 65, the clutch changeover spring 67, the clutch changeover pin 65*a*) which changes over the clutch 60 so that the power is transmitted to the stitch forming device 30 at the time of the stitch formation, and the means (the looper thread guide connecting plate 121, the hollow looper thread guide 7*e*, 8*e*, 9*e*, the hollow looper thread guide 7*f*, 8*f*, 9*f*, the releasing cam 94*c*) which releases the positioning of the positioning device 80, and releases the connection of the threading connecting device 120, and separates the looper thread guide outlet 7*d*, 8*d*, 9*d* and the looper thread inlet 7*a*, 8*a*, 9*a*.

In the operation of the gas carrying threading device of sewing machine which is composed in this way, now, when performing the looper threading, if the looper threading/stitch forming changeover manual operating portion (looper threading/stitch forming changeover manual lever) 91 of the looper threading/stitch forming changeover mechanism 90 is rotated to the clockwise direction B (looper threading side), (FIG. 13 (*b*)), the angle of rotation of the looper threading/stitch forming changeover cam 94 in the clutch changeover transmitter 70 is inhibited by a lever right rotation stopper 94*f*, the looper threading/stitch forming changeover cam 94 rotates around the changeover cam shaft 92 as the rotary axis, and swings the clutch changeover link 72 which is pivotally attached at the clutch, changeover connecting arm 94*b* to the clockwise direction (FIG. 10 (*b*)).

The clutch changeover lever 69 which is attached by the clutch changeover lever shaft 68 at a clutch changeover lever attaching hole 71*b* which is provided at a clutch changeover lever supporting arm 71*a* of the clutch changeover lever supporting pedestal 71 is swung to the counterclockwise direction by a pivot point of the swaging pin 69*a* by the swing of the clutch changeover link 72

The clutch changeover arm 65 which is attached at the clutch changeover arm attaching hole 73*b* which is provided at the clutch changeover arm supporting pedestal 73*a* of the clutch changeover pedestal 73 by the clutch changeover arm shaft 66 and the clutch changeover arm attaching hole 65*b* is swung to the clockwise direction through the clutch changeover spring 67. In this case, the clutch changeover pin 65*a* slides in the inside of the through-hole 73*c* which is provided at the clutch changeover arm supporting pedestal 73*a*, and positions at the left end (FIG. 9 (*b*)).

As this result, the clutch slider 62 of the clutch 60 slides to the pump drive member 61 side, and the clutch changeover pin 65*a* interrupts the transmission of the power to the stitch forming device 30, and the clutch connecting pin 63 is connected to the connecting pin hole of the pump drive member 61 with the rotary drive member 23. The piston 48 of the gas supply pump 41 can be reciprocated by the pump drive (eccentric) cam 42 by the pump drive rod 43 and the pump drive arm 44 (FIG. 7, FIG. 8 (*a*), FIG. 9 (*b*)).

Concerning the clutch changeover pin 65*a*, by the clutch changeover spring 67, the clutch slider 62 slides and contacts to the pump drive member 61, and the contact state is held, and the gas supply pump 41 for the looper threading can be driven, and the pump drive preparing state is achieved. That is, the clutch 60 holds one stable state of the clutch by the elasticity of the clutch changeover spring 67.

In this case, the clutch 60 is the pin clutch, and because the clutch connecting pin 63 is fitted easily to the connecting pin hole of the pump drive member 61 through the rotary drive member 23, the changeover of the clutch can be performed by the weak lateral pressure and without slipping.

When the looper threading/stitch forming changeover manual operating portion (looper threading/stitch forming changeover manual lever) 91 is rotated to the clockwise direction B (looper threading side), in parallel with the changeover of the above-mentioned clutch 60, the engagement of the releasing cam 94*c* (FIG. 11 (*b*)) which is provided at the looper threading/stitch forming changeover cam 94 and the cam follower 121*g* of the looper thread guide connecting plate 121 is released, and in this state, the follower pin 84, and the positioning pin 82 which is fitted to this are fitted to the shaft hole 121*a* of the looper thread guide connecting plate 121 (FIG. 3 (*a*)), and the looper thread guide connecting plate 121 is elastically repelled to the looper side. And because the follower pin end 84*a* of the follower pin 84 is pressed by the pin advance/retreat cam 94*d*, the positioning pin 82 of the positioning device 80 which pierces the positioning pin slide hole 2*aa* and extends advances and is contacted by the pressure to the outer peripheral surface of the positioning plate 81 by the follower pin spring 83 and the positioning pin back spring 86 (FIG. 13 (*b*)).

From the above operation, the connection of the threading connecting device 120 which is disposed so that the connection becomes free at the time of the looper threading and the positioning of the positioning device 80 are prepared.

In such state that the changeover of the clutch 60 and the connection of the threading connecting device 120 and the positioning of the positioning device 80 are prepared, when rotating the pulley 6 which is fixed at one end of the drive shaft 5 manually, the positioning pin 82 is fitted into the notch 81*a* of the positioning plate 81 of the positioning device 80 horizontally at the stop position (FIG. 3 (*b*) FIG. 4 (*b*)) of the circumferential direction for aligning the positions of the looper thread guide outlet 7*d*, 8*d*, 9*d* and the looper thread inlet 7*a*, 8*a*, 9*a* and the thread take-up lever hole 14*a*, 13*a*, 15*a* of the looper thread take-up lever 14, 13, 15, and the rotation of the drive shaft 5 is locked at this aligning position by the positioning pin 82 (FIG. 13 (*c*), FIG. 9 (*b*)).

Because the rotation of the drive shaft 5 is locked by the operation of the positioning plate 81, the positioning device 80 functions as the safety apparatus at the time of the looper threading.

Besides, the positioning pin 82 is fitted into the notch 81*a* of the positioning plate 81, thereby the threading connecting device 120 operates, and the positioning pin 82 disengages from the shaft hole 121*a* of the looper thread guide connecting plate 121, and the looper thread guide connecting plate 121 is elastically repelled to the looper side by the elasticity of the spring 134, and the elongate hole 121*b* of the looper thread guide connecting plates 121 slides on the follower pin 84. In this case, the follower pin 84 is fitted to the elongate hole 121*b* by the positioning pin back spring 83.

Simultaneously, by the elasticity of the spring 134, the looper thread guide connecting plate 121, 136, therefore, the hollow looper thread guide 7*f*, 8*f*, 9*f* which is connected with nested state with the hollow looper thread guide 7*e*, 8*e*, 9*e* of the hollow looper thread guide 130 moves to the side of the upper looper 7, the lower looper 8 and the looper 9 through the supporting hole 131*a*, 139*a* and the thread take-up lever thread guide 133*a*, 139*b*, and the looper thread guide outlet 7*d*, 8*d*, 9*d* and the looper thread inlet 7*a*, 8*a*, 9*a* are connected. In this case, the spring 137 buffers the impact when the looper thread guide outlet 7*d*, 8*d*, 9*d* of the hollow looper thread guide 7*f*, 8*f*, 9*f* and the looper thread inlet 7*a*, 8*a*, 9*a* of the upper looper 7, the lower looper 8 and the looper 9 are connected.

Thereby, the hollow looper thread guide 130 of the threading connecting device 120 becomes the connecting state from the connecting preparatory state (FIG. 3 (*b*), FIG. 4 (*b*)).

In the connecting state of the threading connecting device 120, when inserting each necessary looper thread to the wide-mouthed looper thread insertion slot 113*a*, 113*b*, 113*c* of the looper thread introduction mechanism 110 for about 5-6 mm (¼ inch) (FIG. 1, FIG. 6, FIG. 8) and pushing the threading button 117 of the looper thread introduction pedestal 112, the threading switch 119*b* becomes "ON" and the sewing machine motor M is controlled with the rotation of the constant speed, and the piston 48 of the gas supply pump 41 can be reciprocated by the drive shaft pulley 21 with the timing belt MB, the drive shaft pulley boss 22, the pump drive member 61 from the rotary drive member 23 of the clutch 60, the pump drive cam 42, the pump drive rod 43 and the pump drive arm 44 (FIG. 7, FIG. 8, FIG. 9 (*b*)). In the operation of the gas supply pump 41, concerning the forward process of the piston 48, the piston cap 49 is connected to the inner wall surface of the pump cylinder 50 in the airtight state, and the air is compressed, and pressurized and injected as the compressed air from the delivery port 50*b* to an air inlet 112*a* (FIG. 6, FIG. 8) of the looper thread introduction mechanism 110 through the pipe 54. On the other hand, in the return (inhalation) process of the piston 48, because the piston cap 49 is not connected to the inner wall surface of the pump cylinder 50 in the airtight state and becomes open state, the air is inhaled through the outer circumference of the piston 48 and the piston cap 49, and the back flow of the air which is sent from the delivery port 50*b* is prevented by the back flow stopper ball 51*a* of the back flow stopper valve 51.

The compressed air from the gas supply pump 41 is pressurized and injected from the delivery port 50*b* to the air inlet 112*a* (FIG. 6, FIG. 8 (*a*)) of the looper thread introduction mechanism 110 through the pipe 54, and the jet stream is generated through the ventilation narrow area 114*a* from the gas buffer area 115.

Each looper thread is inhaled from the looper thread inhalation area 114 to the looper thread introduction pipe 116 by sucking with this jet stream, and the gas carrying can be performed to the looper thread loop-taker point outlet 7*b*, 8*b*, 9*b* of the upper looper 7, the lower looper 8 and the looper 9 through the hollow looper thread guide 7*e*, 8*e*, 9*e* of the hollow looper thread guide 130 and the looper thread guide outlet 7*d*, 8*d*, 9*d* of the hollow looper thread guide 7*f*, 8*f*, 9*f* of the threading connecting device 120.

The looper thread guide outlet end 114*b* of the looper thread inhalation area 114 is formed slantingly, thereby the generation of a vortex flow is prevented in the downstream side of the ventilation narrow area 114*a*.

The bottleneck portion 116*c* is formed in the inside of the looper thread introduction pipe 116 which is adjacent to the looper thread inhalation area 114 in the downstream side of the ventilation narrow area 114*a*, and therefore, the gas flow in the ventilation narrow area 114*a* is promoted by reducing the pressure of the downstream side of the bottleneck portion 116*c* and the looper thread is inhaled into the looper thread introduction pipe 116 by generating the negative pressure in the looper thread introduction area 114.

According to the looper thread introduction mechanism 110 of the gas carrying threading device like this, in the insertion operation of the looper thread to the upper looper 7, the lower looper 8 and the looper 9, when inserting the upper looper thread 16*a*, the lower looper thread 16*b* and the looper thread 16*c* from the thread introducing part, the thread introduction of the upper looper thread 16*a*, the lower looper thread 16*b* and the looper thread 16*c* can be performed strongly and certainly by the looper thread introduction mechanism 110.

Besides, according to the gas carrying threading device of sewing machine of the present invention, the pressurized gas for the gas carrying of the threading of the upper looper thread 16*a*, the lower looper thread 16*b* and the looper thread 16*c* is produced by a gas supply pump which is operated by the sewing machine motor M, and the threading of the upper looper thread 16*a*, the lower looper thread 16*b* and the looper thread 16*c* can be performed by one-touch operation.

Further, according to the gas carrying threading device of sewing machine of the present invention, the threading of the upper looper thread 16*a*, the lower looper thread 16*b* and the looper thread 16*c* can be performed in only one hand by the looper threading stitch forming changeover mechanism 90.

Therefore, according to the gas carrying threading device of sewing machine of the present invention, by connecting the hollow thread guide 7*e*, 8*e*, 9*e*, 7*f*, 8*f*, 9*f* which leads from the thread outlet 7*b*, 8*b*, 9*b* of the loop-taker point of the upper looper thread 16*a*, the lower looper thread 16*b*, the looper thread 16*c* to the thread introducing part which inserts the thread, the complicated thread guard is unnecessary and the threading that the handleability is easy can be performed. And, there are no mistake of the threading, no protrusion of the thread in mid-process, and no entanglement of the inserted upper looper thread 16*a*, lower looper thread 16*b* and looper thread 16*c* with other thread. And because the thread is supplied by utilizing the flow of the pressurized gas which is supplied to the hollow thread guide means, the threading can be performed at once by the extremely easy operation.

Next, when performing the stitch formation, if the looper threading/stitch forming changeover manual operating portion (looper threading/stitch forming changeover manual lever) 91 of the looper threading/stitch forming changeover mechanism 90 is rotated and returned to the counterclockwise direction A (stitch formation side), (FIG. 13 (*a*)), the angle of rotation of the looper threading/stitch forming changeover cam 94 is inhibited by a lever left rotation stopper 94*e*, the clutch changeover transmitter 70 operates adversely for the above, and the looper threading/stitch forming changeover cam 94 rotates around the changeover cam shaft 92 as the rotary axis, and swings the clutch changeover link 72 which is pivotally attached at the clutch changeover connecting arm 94*b* to the counterclockwise direction (FIG. 10 (*a*)).

The clutch changeover lever 69 which is attached by the clutch changeover lever shaft 68 at a clutch changeover lever attaching hole 71*b* which is provided at a clutch changeover lever supporting arm 71*a* of the clutch changeover lever supporting pedestal 71 is swung to the clockwise direction by a pivot point of the swaging pin 69*a* by the swing of the clutch changeover link 72.

The clutch changeover arm 65 which is attached at the clutch changeover arm attaching hole 73*b* which is provided at the clutch changeover arm supporting pedestal 73*a* of the clutch changeover pedestal 73 by the clutch changeover arm shaft 66 and the clutch changeover arm attaching hole 65*b* is swung to the counterclockwise direction through the clutch changeover spring 67. In this case, the clutch changeover pin 65*a* slides in the inside of the through-hole 73*c* which is provided at the clutch changeover arm supporting pedestal 73*a*, and positions at the right end (FIG. 9 (*a*)).

As this result, the clutch slider 62 of the clutch 60 slides to the stitch forming drive member 64 side, and the clutch changeover pin 65*a* interrupts the transmission of the power to the pump drive member 61, and the clutch connecting pin 63 is connected to the connecting pin hole of the stitch forming drive member 64 with the rotary drive member 23. Therefore, the power to the drive shaft 5 is transmitted, and the stitch forming device 30 can be driven (FIG. 9 (*a*), FIG. 10 (*a*)).

In this case, the clutch 60 holds other stable state of the clutch by the elasticity of the clutch changeover spring 67. That is, depending on the manual operation of the looper threading/stitch forming changeover manual operating portion (looper threading/stitch forming changeover manual lever) 91, the clutch changeover spring 67 accomplishes the function which moves the clutch slider 62 to the stitch forming drive member 64 which is fixed at one end of the drive shaft 5 and transmits the power to the stitch forming device 30 so that approach/separation becomes free and which holds the contact state.

Therefore, by the timing belt MB from the sewing machine motor M, the drive shaft 5 can be rotated and driven by the drive shaft pulley 21, the drive shaft pulley boss 22 and the stitch forming drive member 64 from the rotary drive member 23 of the clutch 60.

If the looper threading/stitch forming changeover manual operating portion (looper threading/stitch forming changeover manual lever) 91 of the looper threading/stitch forming changeover mechanism 90 is rotated and returned to the counterclockwise direction A (stitch formation side), because the releasing cam 94*c* (FIG. 11 (*b*)) which is provided at the looper threading/stitch forming changeover cam 94 engages the cam follower 121*g* of the looper thread guide connecting plate 121 and deviates to the opposite direction (right direction in FIG. 5 (A)) of the looper side, the looper threading/stitch forming changeover switch 119*a* becomes "ON" at a switch operation part 121*h* of the looper thread guide connecting plate 121, and the sewing machine motor M is rotated and controlled in a variable state through a motor controller (foot controller) MC.

The needle drive mechanism 12 of the stitch forming device 30, the cloth feed mechanism 4 and the looper drive mechanism 10 are driven by the rotation of the drive shaft 5, and the hemstitch seam and (or) the 401 type stitch can be performed on the cloth 25 which is pressed on the throat plate 3 by the presser foot mechanism 19 by the needle 11*a*, 11*b*, 11*c* and the upper looper 7, the lower looper 8, the looper 9 that the looper threading is performed as described above.

Besides, the positioning device 80 operates adversely for the above, and because the press of the follower pin end 84*a* of the follower pin 84 is released by the pin advance/retreat cam 94*d* which is provided at the looper threading/stitch forming changeover cam 94, the positioning pin 82 separates from the notch 81*a* of the positioning plate 81, and because the releasing cam 94*c* (FIG. 11 (*b*)) engages the cam follower 121*g* of the looper thread guide connecting plate 121 and deviates to the opposite direction (right direction in FIG. 5 (A)) of the looper side, the follower pin 84, and the positioning pin 82 which is fitted to this are fitted to the shaft hole 121*a* of the looper thread guide connecting plate 121 from the elongate hole 121*b*. Therefore, in the threading connecting device 120, the looper thread guide outlet 7*d*, 8*d*, 9*d* of the hollow looper thread guide 7*e*, 8*e*, 9*e* and the looper thread inlet 7*a*, 8*a*, 9*a* of the upper looper 7, the lower looper 8 and the looper 9 are separated. Because the looper thread guide outlet 7*d*, 8*d*, 9*d* of the hollow looper thread guide 7*e*, 8*e*, 9*e* and the looper thread inlet 7*a*, 8*a*, 9*a* of the upper looper 7, the lower looper 8 and the looper 9 are separated, the thread take-up lever hole 14*a*, 13*a*, 15*a* of the looper thread take-up lever 14, 13, 15 intervene as the looper thread pass between that, and thereby a looper take-up lever mechanism is performed between the looper thread inlet 7*a*, 8*a*, 9*a* and the thread take-up lever thread guide 133*a*, 139*b*, and the hemstitch seam and (or) the 401 type stitch is performed by the stitch forming device 30 with this looper thread pass separated state.

Figure 21A:
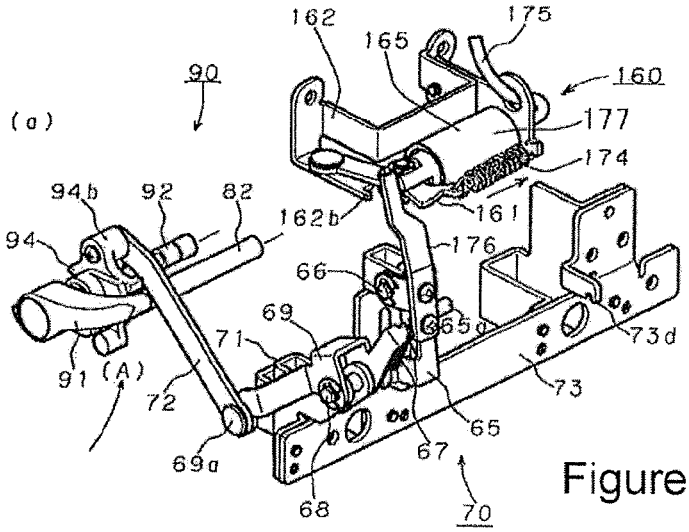
FIG. 21 A motion explanatory view of a clutch changeover restriction mechanism shown in FIG. 14-FIG. 20, (*a*) shows a state which is changed over at the time of a stitch formation, (*b*) shows a state which is changed over at the time of a looper threading, and (*c*) shows a state which avoids a transition from a looper threading state to a stitch forming state.
Figure 21B:
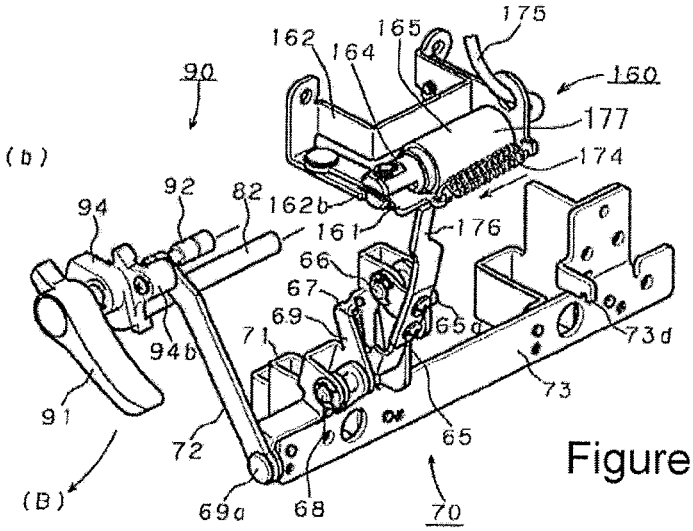
Figure 21C:
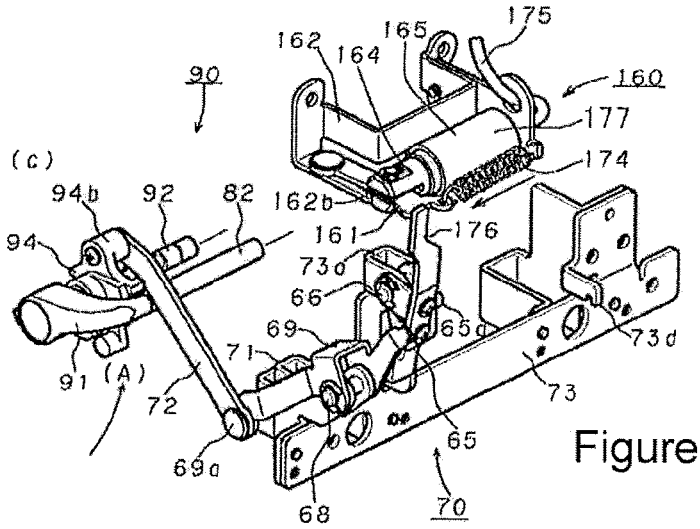
Figure 22:
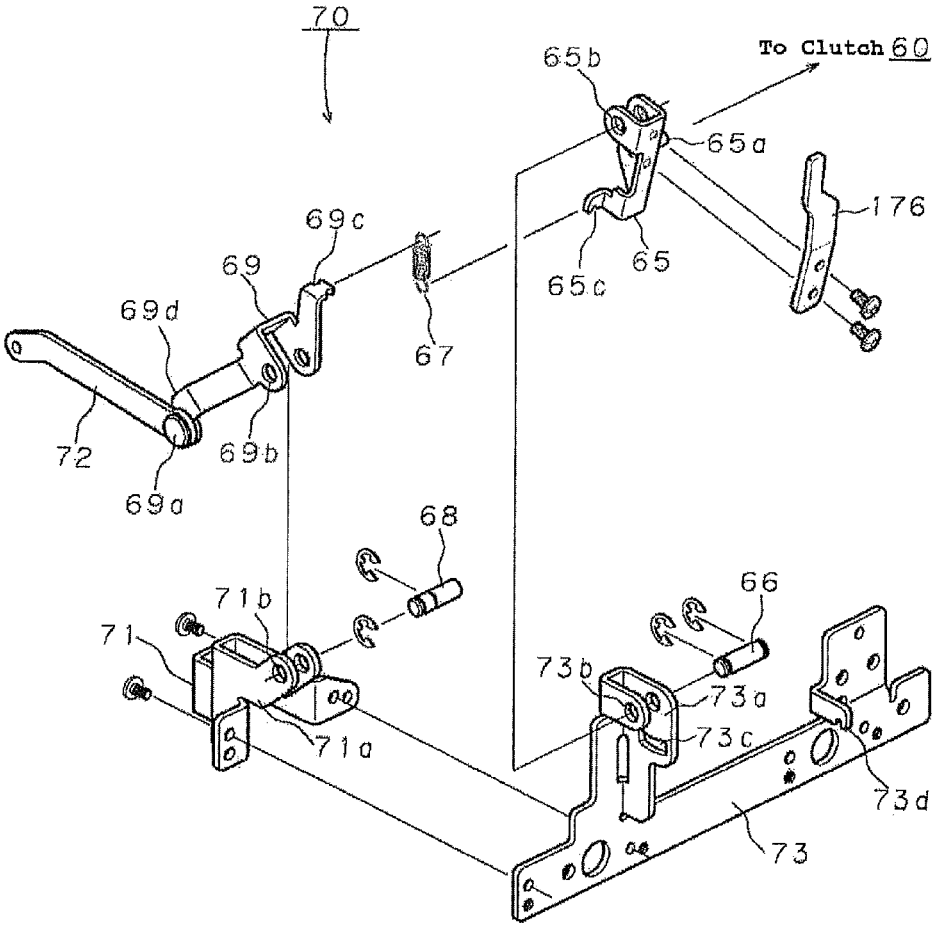
FIG. 22 An exploded perspective view that a clutch changeover restriction mechanism shown in FIG. 14

In the above embodiment, in the sewing machine which is described in the embodiment, in the normal use, if the user pushes the threading button 117 at the time of the looper threading (FIG. 21 (*b*)), and separates the finger from the threading button 117 at the time of the completion of the looper threading, and operates the looper threading/stitch forming changeover manual operating portion (looper threading/stitch forming changeover manual lever) 91 after the predefined short time, for example after 2-3 seconds, and rotates and returns it from the lowermost position to the counterclockwise direction A (stitch formation side), the sewing machine operates normally (FIG. 21 (*a*)).

However, when performing the following particular operation the difficult point that a looper thread inlet 7*a*, 8*a*, 9*a* and a thread take-up lever hole which is formed at a looper thread take-up lever do not align at the looper thread guide outlet horizontally may be caused.

Figure 14:
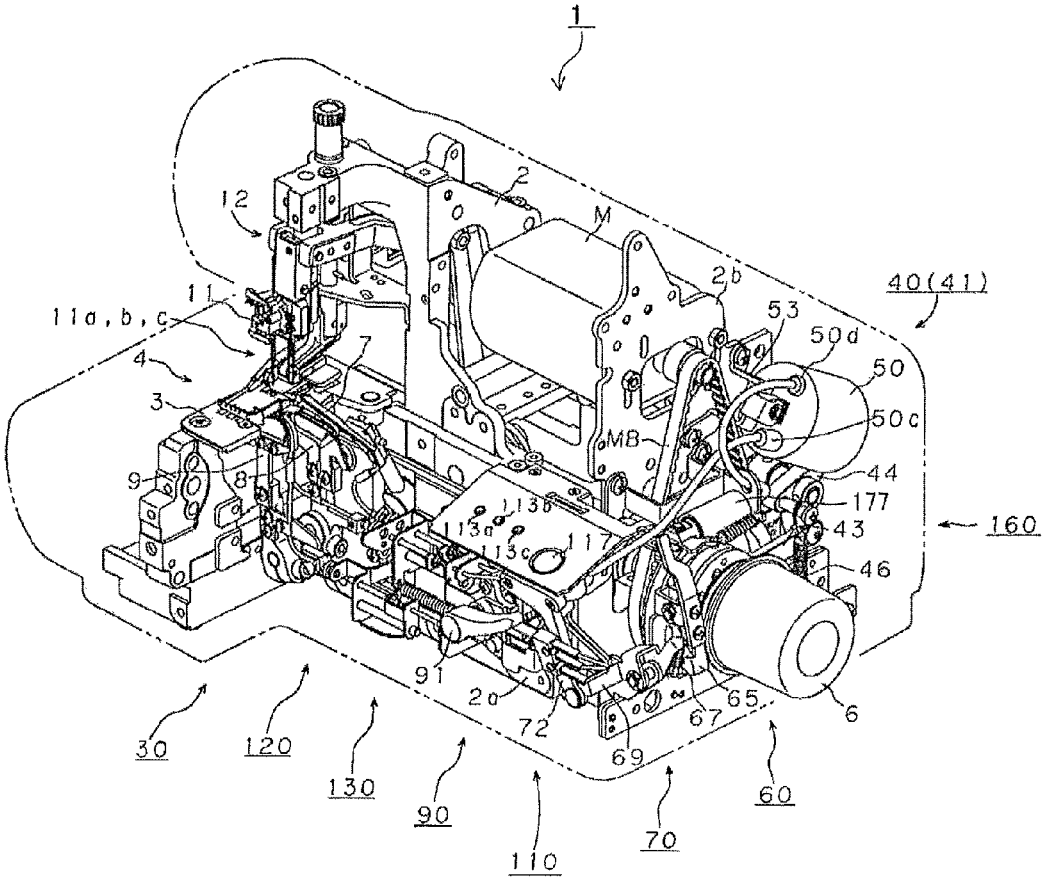
FIG. 14 A perspective view that a clutch changeover restriction mechanism is incorporated in a three-needle/six-thread serger (double chain stitch sewing machine) applying a gas carrying threading device of sewing machine by the present invention.
Figure 15:
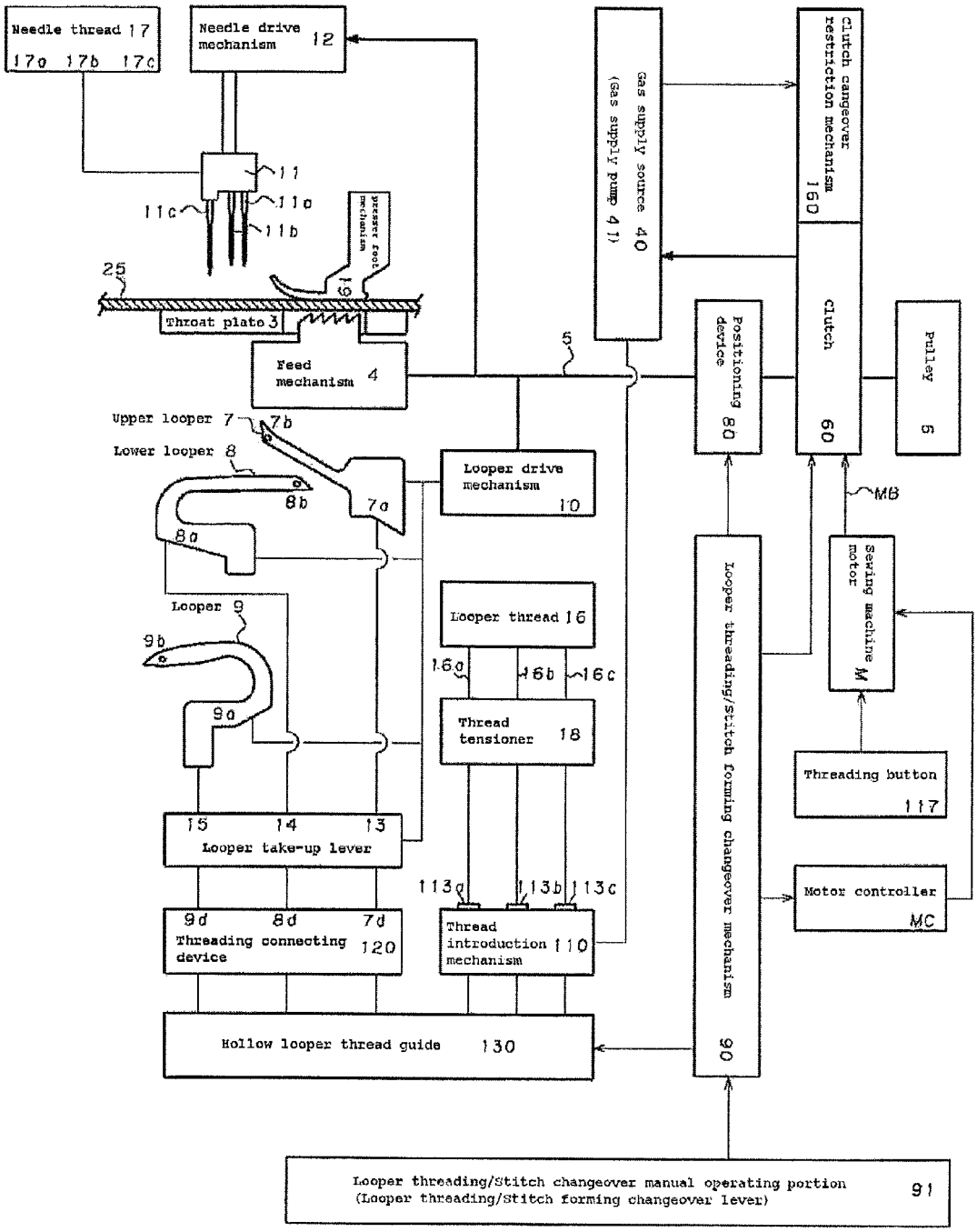
FIG. 15 A block diagram that a clutch changeover restriction mechanism is incorporated in a three-needle/six-thread serger (double chain stitch sewing machine) applying a gas carrying threading device of sewing machine by the present invention.
Figure 16:
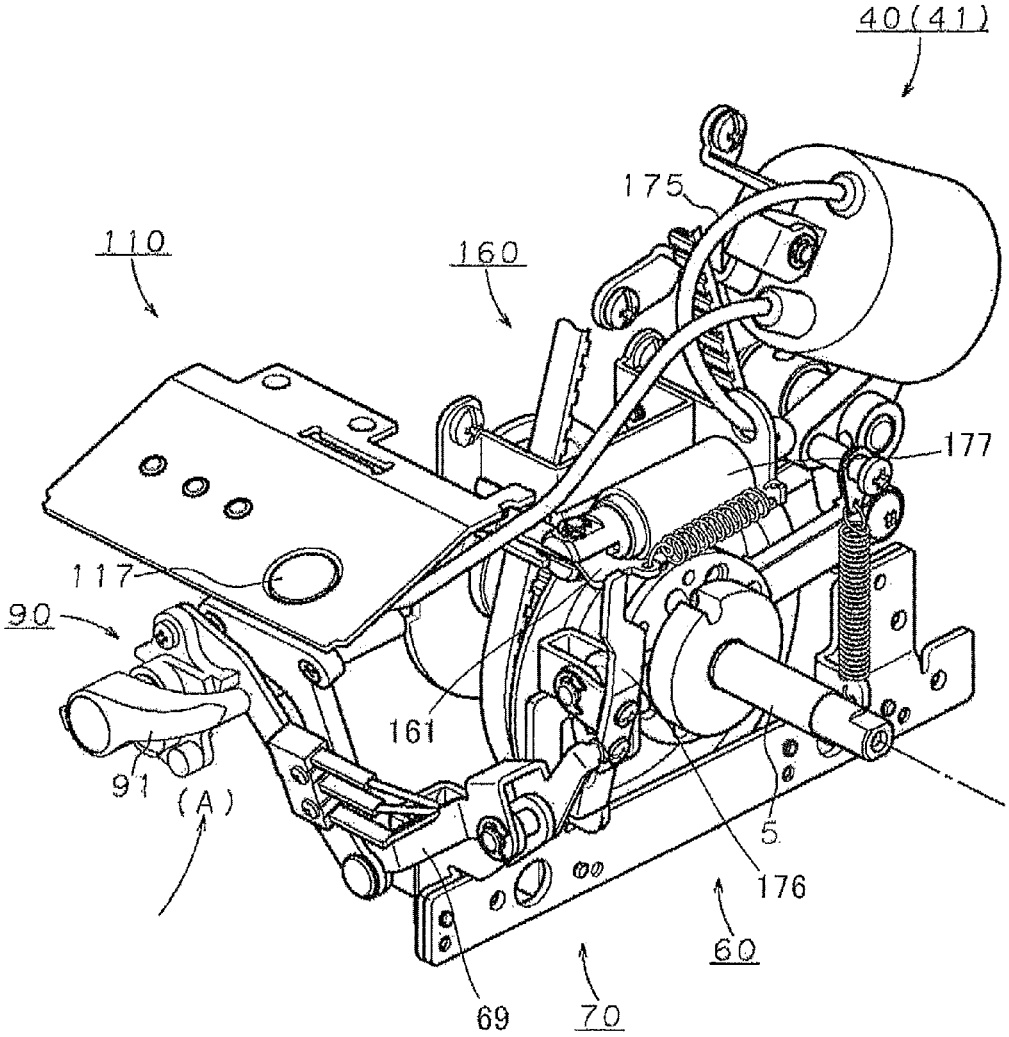
FIG. 16 A perspective view that a pneumatic actuator of a clutch changeover restriction mechanism is incorporated in a gas supply pump and a looper thread introduction mechanism that a gas is supplied thereby which are used in a gas carrying threading device of sewing machine by the present invention.
Figure 17B:
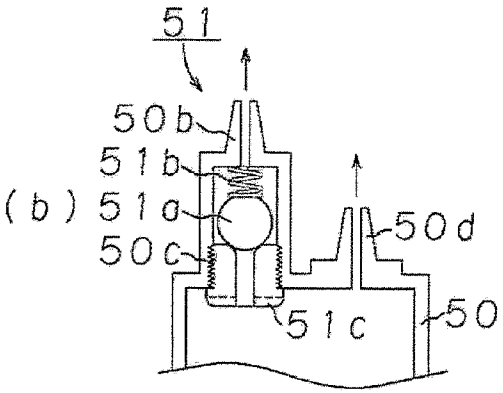
FIG. 17 (*a*) is an exploded perspective view showing a gas supply pump which is suitable to incorporate a pneumatic actuator of a clutch changeover restriction mechanism which is used in gas carrying threading device of sewing machine by the present invention, (*b*) is an explanatory view of a back flow stopper valve which is used in a gas supply pump.
Figure 17A:
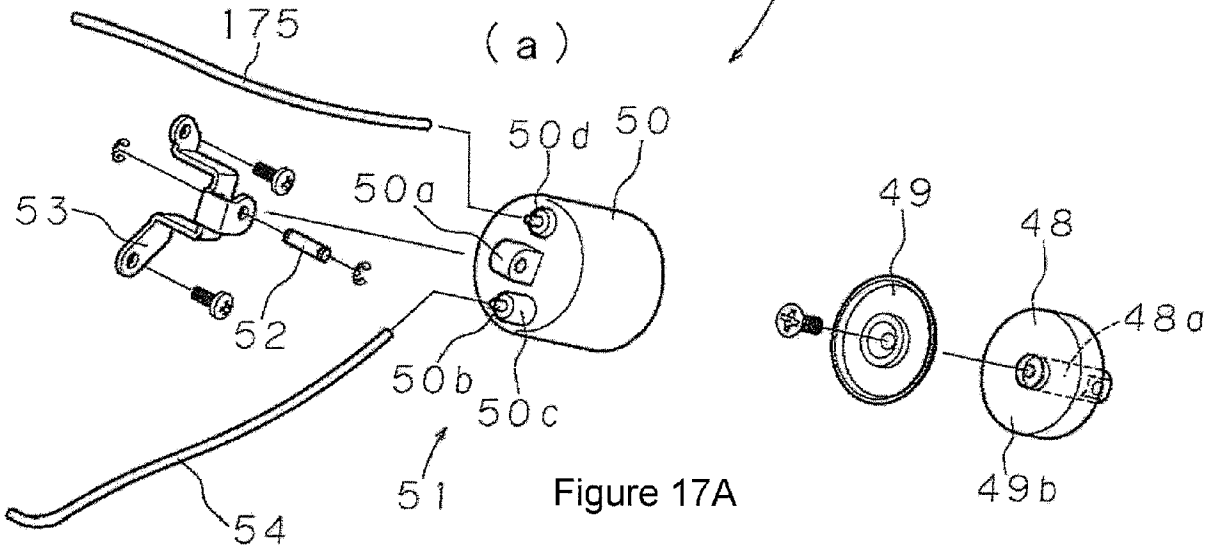
Figure 18A:
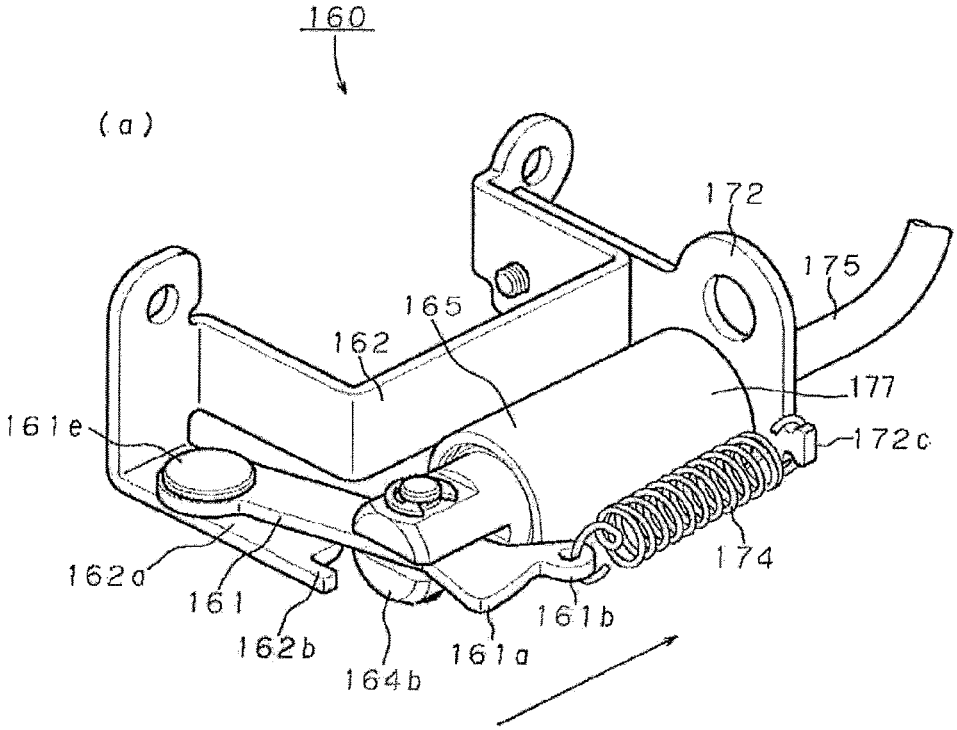
FIG. 18 (*a*) is a perspective view showing a state that a pneumatic actuator of a clutch changeover restriction mechanism retreats to an original position, (*b*) is a perspective view showing a state that a pneumatic actuator of a clutch changeover restriction mechanism extends.
Figure 18B:
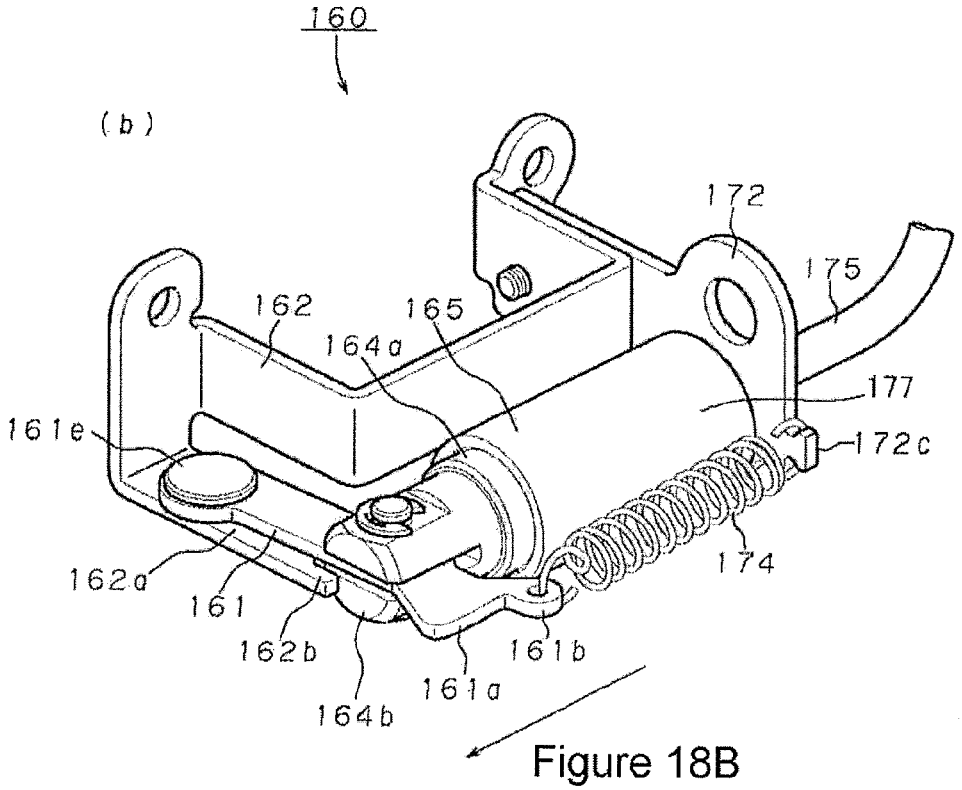

1. The case that both hands are used at the same time, and while pushing the threading button 117 by one hand, the looper threading/stitch forming changeover manual operating portion (looper threading/stitch forming changeover manual lever) 91 is operated by other hand without separating the finger from the threading button 117 at the time of the completion of the looper threading, and is rotated and returned from the lowermost position to the counterclockwise direction A (stitch formation side);

2. The case that the threading button 117 is pushed at the time of the looper threading, and the finger is separated from the threading button 117 at the time of the completion of the looper threading, and instantaneously the looper threading/stitch forming changeover manual operating portion (looper threading/stitch forming changeover manual lever) 91 is operated and is rotated and returned from the lowermost position to the counterclockwise direction A (stitch formation side);

In order to resolve the above difficult points, in the gas carrying threading device of sewing machine of the present invention, the clutch changeover restriction mechanism 160 for avoiding the transition of the looper threading/stitch forming changeover mechanism 90 from the looper threading state to the stitch forming state during the gas supply operation of the gas supply pump 41 is equipped (FIG. 14-FIG. 16).

In the gas carrying threading device of sewing machine of the present invention, during the gas supply operation of the gas supply pump 41, the clutch changeover restriction mechanism 160 has a pneumatic actuator 177 that the gas is supplied from the gas supply pump 41 and a connecting device (changeover restriction plate 161, clutch restriction arm 176) for avoiding the transition of the looper threading/stitch forming changeover mechanism 90 from the looper threading state to the stitch forming state by the gas supply of the pneumatic actuator 177 (FIG. 16, FIG. 18, FIG. 20, FIG. 22).

Figure 19A:
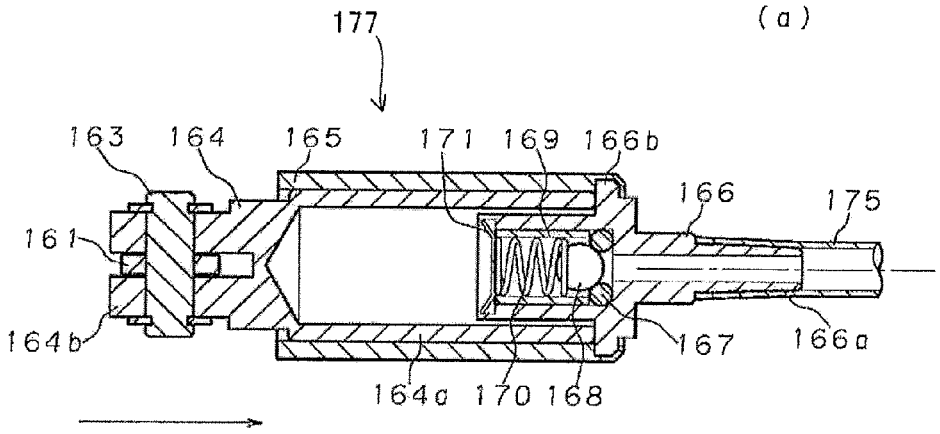
FIG. 19 (*a*) is a sectional view showing a state that a pneumatic actuator of a clutch changeover restriction mechanism retreats to a retreated original position, (*b*) is a sectional view showing a state that a pneumatic actuator of a clutch changeover restriction mechanism extends.
Figure 19B:
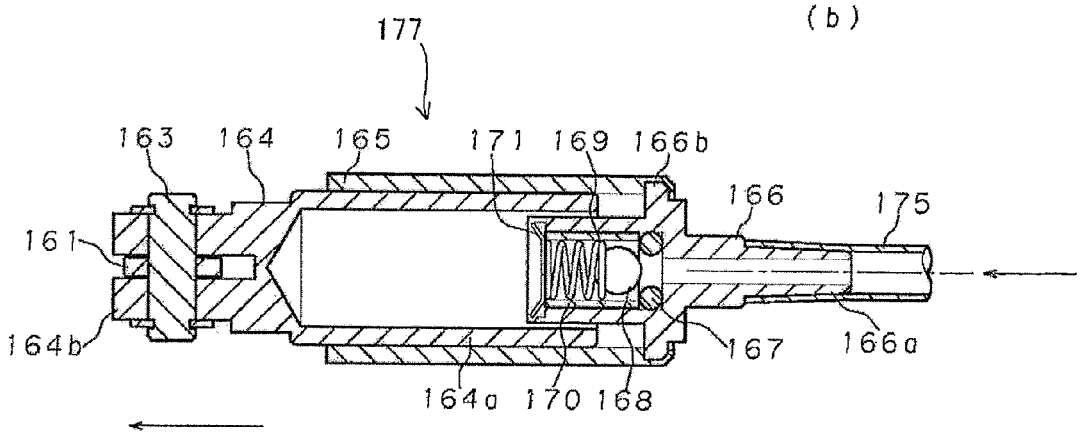
Figure 20:
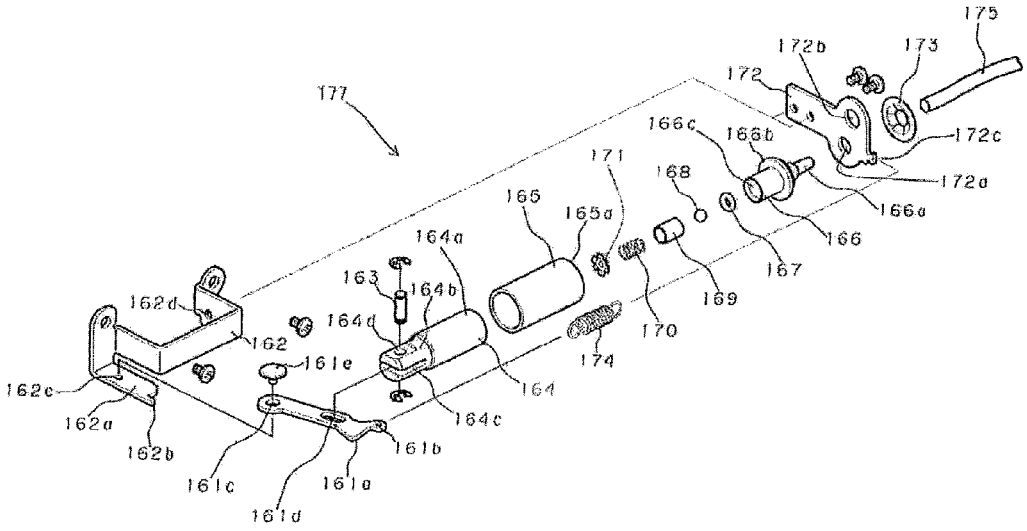
FIG. 20 An exploded perspective view showing a clutch changeover restriction mechanism shown in FIG. 14-FIG. 19.

In the gas carrying threading device of sewing machine of the present invention, the pneumatic actuator 177 has a piston cylinder 164, 165 that a piston 164 performs the operation of the elongation by the gas supply of the gas supply pump 41 and a retarder 164*e* which delays the gas of the inside of the pneumatic actuator 177 after the gas from the gas supply pump 41 is not supplied and which exhausts the gas by spending time little by little (FIG. 19, FIG. 20).

In the gas carrying threading device of sewing machine of the present invention, the pneumatic actuator 177 has a spring 174 which deviates the pneumatic actuator 177 to the retreated original position and accelerates the exhaust of the retarder 164*e*.

Hereinafter, the clutch changeover restriction mechanism 160 is explained in detail further.

Essentially, as shown in FIG. 14-FIG. 16, the changeover restriction mechanism 160 is provided together to the clutch 60, and a delivery port for cylinder 50*d* is provided at the pump cylinder 50 of the gas supply source 40, and the compressed, air is supplied through the pipe 175 from the delivery port 50*d* to a restriction cylinder 165 as the pneumatic actuator 177 of the changeover restriction mechanism 160.

Besides, when the clutch changeover lever 69 rotates to the clockwise direction and the clutch changeover spring 67 which is stretched and provided is elastically repelled and thereby the clutch changeover arm 65 swings to the counterclockwise direction, the clutch restriction arm 176 that the after-mentioned changeover restriction plate 161 protrudes and touches a changeover restriction end 161*a* which is provided at the front edge, and that the swing to the counterclockwise direction of the clutch changeover arm 65 is restricted is fixed at the clutch changeover arm 65 of the looper threading/stitch forming changeover mechanism 90.

That is, as shown in FIG. 16, FIG. 17, FIG. 18, FIG. 20 and FIG. 22, in the changeover restriction mechanism 160, the restriction cylinder 165 is fixed at a restriction cylinder attaching plate 172 which is fixed at one end of a restriction mechanism attaching pedestal 162, and a changeover restriction plate attaching arm 162*a* is formed at the other end of the restriction mechanism attaching pedestal 162, and a pivot hole 161*c* of the changeover restriction plate 161 is pivotally attached swingably by a swaging pin 162*e* at the base of the changeover restriction plate attaching arm 162*a*, and a piston stopper 162*b* is provided at the front edge. The changeover restriction plate 161 has the changeover restriction end 161*a* and a spring stud 161*b* at the front edge, and has a connecting elongate hole 161*d* which is connected slidably by a connecting pin 163 which pierces a restriction piston connecting hole 164*d* by fitting to a restriction piston connecting groove 164*c* which is provided at a restriction piston connecting portion 164*b* of a restriction piston 164 at the center portion.

The changeover restriction plate 161 is equipped with the changeover restriction end 161*a* and the spring stud 161*b* at the front edge, and a changeover restriction plate spring 174 is stretched and laid between the spring stud 161*b* and a spring stud 172*c* which is provided at one end of the restriction cylinder attaching plate 172.

The compressed air is supplied from the delivery port for cylinder 50*d* of the pump cylinder 50 to an air inlet 166*a* which is formed at a back flow stopper valve 166 that the pipe 175 is fixed at one end of the restriction cylinder 165.

The back flow stopper valve 166 is equipped with a flange 166*b* and a valve housing 166*c*, and a valve pipe 169 which is fixed by a push nut is installed inside in the valve housing 166*c*, and the back flow stopper valve 166 is equipped with a spring 170, a back flow stopper ball 168 which is pressed by the spring 170 and an O-ring which opens the valve by floating the back flow stopper ball 168 by the delivery pressurized air at the time of the elongation (pressurization, forward) process and closes the valve by seating the back flow stopper ball 168 by the press of the spring 170 at the time of the retreat (exhaust, return) process.

The restriction piston 164 of the pneumatic actuator 177 fits loosely from the other end of the restriction cylinder 165, and protrudes until the front edge of the restriction piston connecting portion 164*b* touches the piston stopper 162*b* of the changeover restriction plate attaching arm 162*a* by the delivery pressurized air at the time of the elongation (pressurization, forward) process, and swings the changeover restriction plate 161 which is connected to the restriction piston connecting portion 164*b* by the connecting pin 163.

Besides, in the restriction piston 164 of the pneumatic actuator 177 at the time of the retreat (exhaust, return) process, the valve closes by seating the back flow stopper ball 168 which is pressed by the spring 170, and although the protrusion tries to be kept, the pressurized air is exhausted little by little by spending time from the retarder (exhaust narrow passage) 164*e* which is provided at the outer circumference of the restriction piston 164, and the changeover restriction plate spring 174 which is stretched and laid between the spring stud 161*b* of the changeover restriction plate 161 and the spring stud 172*c* of the restriction cylinder attaching plate 172 is elastically repelled, and thereby the changeover restriction plate 161 is drawn back. Therefore, the restriction piston 164 is also drawn back gradually.

Thereby, even if the circuit of the threading switch 119*b* in the sewing machine motor M becomes "OFF", when the sewing machine motor M continues the rotation for a few seconds by the rotary inertia, the pressurized air is supplied through the pipe 175 from the delivery port for cylinder 50*d* of the pump cylinder 50 of the gas supply source 40 to the restriction cylinder 165 of the changeover restriction mechanism 160, and the restriction piston 164 of the pneumatic actuator 177 holds the state that the front edge of the restriction piston connecting portion 164*b* touches the piston stopper 162*b* of the changeover restriction plate attaching arm 162*a*, and also the changeover restriction plate 161 which is connected to the restriction piston connecting portion 164*b* by the connecting pin 163 protrudes, and the upper portion of the clutch restriction arm 176 touches the changeover restriction end 161*a* which is provided at the front edge, and the swing to the counterclockwise direction of the clutch changeover arm 65 is inhibited and restricted (FIG. 21 (*c*)).

When the rotation of the sewing machine M stops, the delivery of the pressurized air from the gas supply source 40 to the restriction cylinder 165 of the pneumatic actuator 177 disappears, and the changeover restriction plate spring 174 which is stretched and laid between the spring stud 161*b* of the changeover restriction plate 161 and the spring stud 172*c* of the restriction cylinder attaching plate 172 is elastically repelled, and thereby the restriction piston 164 of the pneumatic actuator 177 is drawn back gradually by exhausting the pressurized air of the inside of the restriction cylinder 165 extremely little by little from the retarder (exhaust narrow passage) 164*e* which is provided at the outer circumference of the restriction piston 164 along with the changeover restriction plate 161. Meantime, the looper threading/stitch forming changeover manual operating portion (looper threading/stitch forming changeover manual lever) 91 reaches the uppermost position of the counterclockwise direction A (FIG. 21 (*a*)), and the shaft hole 121*a* of the looper thread guide connecting plates 121 corresponds to the central point of the follower pin 84 which fits to the elongate hole 121*b*, and the protrusion of the positioning pin 82 is not maintained. The positioning pin back spring 86 is elastically repelled, and thereby the positioning pin 82 is pushed back, and after the fixing of the positioning of the drive shaft 5 is released, the changeover restriction end 161*a* of the protruded changeover restriction plate 161 retreats, the inhibition of the swing of the clutch changeover arm 65 of the clutch restriction arm 176 is released, and subsequently the clutch changeover arm 65 swings to the counterclockwise direction, the clutch changeover pin 65*a* swings to the pulley 6 side, the clutch slider 62 is slid to the stitch forming drive member 64 side, and the clutch connecting pin 63 connects to the connecting pin hole of the stitch forming drive member 64 by the rotary drive member 23 (FIG. 9 (*a*)).

Thereby, because the above-mentioned particular changeover operation from the looper threading state to the stitch forming state is not performed, the changeover from the looper threading state to the stitch forming state can be performed normally without causing the difficult point that the looper thread inlet 7*a*, 8*a*, 9*a* and the thread take-up lever hole which is formed at the looper thread take-up lever do not align at the looper thread guide outlet horizontally.

As is clear from the above-mentioned explanation, according to the gas carrying threading device of sewing machine of the present invention, in the insertion operation of the looper thread to the looper, when inserting the looper thread from the thread introducing part, the thread introduction of the looper thread and the gas carrying can be performed certainly by the looper thread introduction mechanism.

Besides, according to the gas carrying threading device of sewing machine of the present invention, the pressurized gas for the gas carrying of the looper thread is produced by a gas supply pump which is operated by the sewing machine motor, and the threading to the looper can be performed by one-touch operation by the looper threading/stitch forming changeover manual operating portion (looper threading/stitch forming changeover manual lever) 91.

Further, according to the gas carrying threading device of sewing machine of the present invention, the threading to the looper can be performed in one hand by the looper threading/stitch forming changeover manual operating portion (looper threading/stitch forming changeover manual lever) 91 and the looper threading/stitch forming changeover mechanism.

Therefore, according to the gas carrying threading device of sewing machine of the present invention, by connecting the hollow thread guide which leads from the thread outlet of the loop-taker point of the looper to the thread introducing part which inserts the thread, the complicated thread guard is unnecessary and the threading that the handleability is easy can be performed. And, there are no mistake of the threading, no protrusion of the thread in mid-process, and no entanglement of the inserted looper thread with other thread. And because the thread is supplied by utilizing the flow of the pressurized gas which is supplied to the hollow thread guide means, the threading can be performed at once by the extremely easy operation.

Besides, according to the gas carrying threading device of sewing machine of the present invention, because a particular changeover operation from a looper threading state to a stitch forming state is not performed by a clutch changeover restriction mechanism, a changeover from the looper threading state to the stitch forming state can be performed normally without causing the difficult point that a looper thread inlet and a thread take-up lever hole which is formed at a looper thread take-up lever do not align at the looper thread guide outlet horizontally.

INDUSTRIAL APPLICABILITY

The gas carrying threading device of sewing machine in the present device can be applied suitably to the chain stitch sewing machine such as the serger, the double chain stitch sewing machine, or the interlock stitch sewing machine for performing the threading automatically to the looper by utilizing the pressurized gas.

EXPLANATION OF THE NUMERALS

M sewing machine motor
5 drive shaft
6 pulley
7, 8, 9 looper
7*a*, 8*a*, 9*a* looper thread inlet
7*b*, 8*b*, 9*b* looper loop-taker point thread outlet
7*d*, 8*d*, 9*d* looper thread guide outlet
7*e*, 8*e*, 9*e*, 7*f*, 8*f*, 9*f* hollow looper thread guide
14, 13, 15 looper take-up lever
14*a*, 13*a*, 15*a* thread take-up lever hole
16*a*, 16*b*, 16*c* looper thread
23, 61, 64, 65, 65*a*, 69, 91, 94 clutch changeover means
30 stitch forming device
40 gas supply source
(41 gas supply pump)
60 clutch
61 pump drive member
62 clutch slider
64 stitch forming drive member
67 clutch changeover spring
70 clutch changeover transmitter
(65, 65*a*, 94, 69 clutch changeover transmitter)
80 positioning device
81 stop positioning plate
81*a* notch
81, 82, 84, 94*d*, 121, 134 positioning preparation/connecting preparation/interrupting/connecting means
82 positioning pin
82, 84, 94*c*, 121, 134 positioning release/connecting release/separating means
90 looper threading/stitch forming changeover mechanism
91 looper threading/stitch forming changeover manual operating portion (looper threading/stitch forming changeover manual lever)
94*d* pin advance/retreat cam
94*c* releasing cam
110 looper thread introduction mechanism
113*a*, 113*b*, 113*c* wide-mouthed looper thread insertion slot
114 looper thread inhalation area
114*a* ventilation narrow area
114*b* looper thread guide outlet end
115 gas buffer area
116 looper thread introduction pipe
116*a* one end part
116*b* other end part
116*c* bottleneck portion
120 threading connecting device
130 hollow looper thread guide
160 clutch changeover restriction mechanism connecting device
(161 changeover restriction plate, 176 clutch restriction arm)
164, 165 piston cylinder
164*e* retarder
174 spring
177 pneumatic actuator

The invention claimed is:

1. A gas carrying threading device of sewing machine comprising:

at least one looper having a hollow structure from a looper thread inlet to a looper loop-taker point thread outlet, a looper thread introduction mechanism inserting a looper thread which is led to the looper, a hollow looper thread guide extending from said looper thread introduction mechanism to the looper thread inlet and having a looper thread guide outlet, and a gas supply source that a looper threading of the looper thread is performed from the looper thread introduction mechanism to the looper thread guide outlet through the hollow looper thread guide by gas carrying, the looper thread introduction mechanism comprising a looper thread insertion slot which inserts the looper thread and a looper thread inhalation area which leads to the looper thread insertion slot, a gas buffer area that pressurized gas is supplied from the gas supply source, and a looper thread introduction pipe which is fitted to the looper thread inhalation area at a first end part and is connected to the hollow looper thread guide at a second end part, the looper thread inhalation area and the looper thread introduction pipe forming a ventilation narrowed area which leads to the gas buffer area and generates a jet stream in a downstream portion of the looper thread inhalation area, and a looper thread guide outlet end of the looper thread inhalation area formed slantingly to prevent from generation of a vortex flow in a downstream side of the ventilation narrowed area.

2. A gas carrying threading device of sewing machine according to claim 1, wherein:

a bottleneck portion is formed on an inside of the looper thread introduction pipe which is adjacent to the looper thread inhalation area in a downstream side of the ventilation narrowed area, and said gas flow in the ventilation narrowed area is promoted by reducing pressure of the downstream side of the bottleneck portion and the looper thread is inhaled into the looper thread introduction pipe by generating negative pressure in the looper thread inhalation area, and the gas carrying is performed to the looper thread loop-taker point outlet of the looper through the hollow looper thread guide.

3. A gas carrying threading device of sewing machine according to claim 1 or 2, wherein:

the looper thread guide outlet and the looper thread inlet are disposed at a time of looper threading to be connected and at a time of stitch forming by the sewing machine to be separated respectively.

4. A gas carrying threading device of sewing machine comprising:

at least one looper having a hollow structure from a looper thread inlet to a looper loop taker point thread outlet, a looper thread introduction mechanism inserting a looper thread which is led to the looper, a hollow looper thread guide extending from said looper thread introduction mechanism to the looper thread inlet and having a looper thread guide outlet, a gas supply pump that a looper threading of the looper thread is performed from the looper thread introduction mechanism to the looper thread guide outlet through the hollow looper thread guide by gas carrying, a clutch for respectively transmitting power from a sewing machine motor to a drive shaft driving a stitch forming device including the looper at a time of stitch forming or to the gas supply pump at a time of the looper threading, and a looper threading/stitch forming changeover mechanism for changing over the clutch so that transmission of the power to the stitch forming device is interrupted and the power is transmitted to the gas supply pump at the time of the looper threading and so that the power is transmitted to the stitch forming device and the transmission of the power to the gas supply pump is interrupted at the time of stitch forming.

5. A gas carrying threading device of sewing machine according to claim 4, wherein:

the clutch comprises a pin clutch having a clutch slider which is moved to one of a pump drive member which transmits the power to the gas supply pump and a stitch forming drive member which is fixed to one end of the drive shaft and that the power is transmitted to the stitch forming device to be connected/separated through a clutch changeover spring depending on a manual operation of a looper threading/stitch forming changeover manual operating portion and that a connected/separated state is held and the power from the sewing machine motor is transmitted.

6. A gas carrying threading device of sewing machine according to claim 4, wherein:

the looper thread guide outlet and the looper thread inlet are equipped with a threading connecting device which is connected and separated, respectively, at the time of the looper threading and at the time of the stitch forming depending on the manual operation of the looper threading/stitch forming changeover manual operating portion.

7. A gas carrying threading device of sewing machine according to claim 4, wherein:

a positioning device is equipped, which, by rotating a pulley which is fixed at one end of the drive shaft manually, when the looper thread guide outlet and the looper thread inlet are aligned horizontally, connects the looper thread guide outlet of the hollow looper thread guide and the looper thread inlet of the looper.

8. A gas carrying threading device of sewing machine according to claim 4, wherein:

the looper threading/stitch forming changeover mechanism, at the time of looper threading, comprises means which changes over the clutch so that the power is transmitted to the gas supply pump, means that the positioning of a positioning device which connects the looper thread guide outlet of the hollow looper thread guide and the looper thread inlet of the looper is prepared, and connection of a threading connecting device which is disposed to be connected and to be separated, respectively, at the time of the looper threading and at the time of the stitch forming is prepared, and the positioning device operates and the transmission of the power to the stitch forming device is interrupted by rotating manually the pulley which is fixed at one end of said drive shaft, and the threading connecting device operates and the looper thread guide outlet and the looper thread inlet are connected, means which, at the time of stitch forming changes over the clutch so that the power is transmitted to the stitch forming device, and means which releases the positioning of the positioning device, and releases the connection of the threading connecting device, and separates the looper thread guide outlet and the looper thread inlet.

9. A gas carrying threading device of sewing machine according to claim 7, wherein:

the positioning device comprises a stop positioning plate which is coaxially attached at the drive shaft and has a notch at a stop position of a circumferential direction for aligning horizontally the position of the looper thread guide outlet, a thread take-up lever hole which is formed at a looper take-up lever and the looper thread inlet, and a positioning pin which is fitted to the notch by rotating the pulley manually at the time of the looper threading that the looper threading/stitch forming changeover manual operating portion is changed over to a looper threading side and operated manually.

10. A gas carrying threading device of sewing machine comprising:

at least one looper having a hollow structure from a looper thread inlet to a looper loop-taker point thread outlet, a looper thread introduction mechanism inserting a looper thread which is led to the looper, a hollow looper thread guide extending from the looper thread introduction mechanism to the looper thread inlet and having a looper thread guide outlet, a gas supply pump that a looper threading of the looper thread is performed from the looper thread introduction area mechanism to the looper thread guide outlet through the hollow looper thread guide by gas carrying, a clutch for respectively transmitting power from a sewing machine motor to a drive shaft driving a stitch forming device including the looper at a time of the stitch forming or to the gas supply pump at a time of the looper threading, and a looper threading/stitch forming changeover mechanism for changing over the clutch so that the transmission of the power to the stitch forming device is interrupted and the power is transmitted to the gas supply pump at the time of the looper threading and so that the power is transmitted to the stitch forming device and the transmission of the power to the gas supply pump is interrupted at the time of the stitch formation, the looper threading/stitch forming changeover mechanism comprising a clutch changeover transmitter which changes over the clutch so that the power is transmitted to the gas supply pump at the time of the looper threading, a positioning device comprising a stop positioning plate which is coaxially attached at the drive shaft and a notch at a stop position of a circumferential direction for aligning the positions of the looper thread guide outlet and said looper thread inlet horizontally, and a positioning pin which connects a threading connecting device which can fit to the notch by rotating a pulley which is fixed at one end of the drive shaft manually at the time of the looper threading and which is connected/separated at the time of the looper threading and at the time of the stitch formation, respectively, a pin advance/retreat cam for advancing and retreating the positioning pin for the stop positioning plate and connecting the threading connecting device, and a releasing cam for separating the looper thread guide outlet and the looper thread inlet by releasing the threading connecting device.

11. A gas carrying threading device of sewing machine according to claim 4 or 9, comprising:

a clutch changeover restriction mechanism for avoiding a transition of the looper threading/stitch forming changeover mechanism from a looper threading state to a stitch forming state during gas supply operation of the gas supply pump.

12. A gas carrying threading device of sewing machine according to claim 11, wherein:

the clutch changeover restriction mechanism, during gas supply operation of the gas supply pump, comprises a pneumatic actuator that the gas is supplied from the gas supply pump and a connecting device for avoiding the transition of the looper threading/stitch forming changeover mechanism from the looper threading state to the stitch forming state by the gas supply of the pneumatic actuator.

13. A gas carrying threading device of sewing machine according to claim 12, wherein:

the pneumatic actuator has comprises a piston cylinder that a piston performs an operation of the elongation by the gas supply of the gas supply pump and a retarder which delays the gas of an inside of the pneumatic actuator and exhausts the gas by spending time little by little after the gas from the gas supply pump is not supplied.

14. A gas carrying threading device of sewing machine according to claim 13, wherein:

the pneumatic actuator comprises a spring which deviates the pneumatic actuator to the retreated original position and accelerates the exhaust of the retarder.

* * * * *

UNITED STATES PATENT AND TRADEMARK OFFICE

CERTIFICATE OF CORRECTION

PATENT NO. : 8,925,472 B2
APPLICATION NO. : 13/399071
DATED : January 6, 2015
INVENTOR(S) : Kouichi Sakuma et al.

It is certified that error appears in the above-identified patent and that said Letters Patent is hereby corrected as shown below:

In the Specification:
Column 7, line 45, insert a --,-- after the word "Hereinafter";
Column 15, line 3, insert a --.-- at the end of the sentence;
Column 17, line 48, delete "threading stitch" and insert --threading/stitch--;
Column 20, line 41, delete "," after the word "pressed".

In the Claims:
Claim 4, Column 25, line 10, delete "loop taker" and insert --loop-taker--.

Signed and Sealed this
Fourteenth Day of April, 2015

Michelle K. Lee

Michelle K. Lee
*Director of the United States Patent and Trademark Office*